US005448227A

United States Patent [19]

Orban et al.

[11] Patent Number: 5,448,227

[45] Date of Patent: Sep. 5, 1995

[54] METHOD OF AND APPARATUS FOR MAKING NEAR-BIT MEASUREMENTS WHILE DRILLING

[75] Inventors: Jacques Orban, Sugar Land; Neil W. Richardson, Houston, both of Tex.

[73] Assignee: Schlumberger Technology Corporation, Sugar Land, Tex.

[21] Appl. No.: 150,941

[22] Filed: Nov. 10, 1993

Related U.S. Application Data

[63] Continuation-in-part of Ser. No. 823,789, Jan. 21, 1992, abandoned.

[51] Int. Cl.[6] ..... G01V 1/40

[52] U.S. Cl. ..... 340/854.4; 340/855.4; 340/855.5; 340/855.8; 340/855.9; 367/82; 367/83; 175/40

[58] Field of Search ..... 340/853.3, 853.4, 853.6, 340/854.3, 854.4, 854.6, 856.1, 855.8, 855.9, 855.4, 855.5; 367/82, 83; 166/250; 175/40, 50; 324/356, 369

[56] References Cited

U.S. PATENT DOCUMENTS 3,932,836 1/1976 Harrell et al. ..... 175/40
4,401,939 8/1983 Korbell ..... 322/59
4,479,564 10/1984 Tanguy ..... 181/105
4,924,125 5/1990 Clark ..... 310/67 R
5,160,925 11/1992 Dailey et al. ..... 340/853.3
5,163,521 11/1992 Pustanyk et al. ..... 175/40
5,166,908 11/1992 Montgomery ..... 367/165

*Primary Examiner*—Ian J. Lobo
*Attorney, Agent, or Firm*—David L. Moseley; Wayne I. Kanak

[57] ABSTRACT

In accordance with illustrative embodiments of the present invention, a measuring-while-drilling system includes a sensor sub positioned at the lower end of a downhole motor assembly so that the sub is located near the drill bit. The sub houses instrumentalities that measure various downhole parameters such as inclination of the borehole, the natural gamma ray emission of the formations, the electrical resistivity of the formations, and a number of mechanical drilling performance parameters. Sonic or electromagnetic telemetry signals representing these measurements are transmitted uphole to a receiver associated with a conventional MWD tool located above the motor, and telemetered by this tool to the surface substantially in real time. The system has particular application to accurate control over the drilling of extended reach and horizontally drilled wells.

24 Claims, 13 Drawing Sheets

METHOD OF AND APPARATUS FOR MAKING NEAR-BIT MEASUREMENTS WHILE DRILLING

FIELD OF THE INVENTION

This invention relates generally to making downhole measurements during the drilling of a well bore with a drilling motor that drives a drill bit, and is a continuation-in-part of U.S. application Ser. No. 07/823,789, filed Jan. 21, 1992, now abandoned.

BACKGROUND OF THE INVENTION

To make downhole measurements while a borehole is being drilled, measuring-while-drilling (MWD) and/or a logging-while-drilling (LWD) systems are generally known which measure various useful parameters and characteristics such as the inclination and azimuth of the borehole, formation resistivity, and the natural gamma ray emissions from the formations. Signals which are representative of these measurements made downhole are relayed to the surface with a mud pulse telemetry device that controls a valve which interrupts the mud flow and creates encoded pressure pulses inside the drill string. The pulses travel upward through the mud to the surface where they are detected and decoded so that the downhole measurements are available for observation and interpretation at the surface substantially in real time.

In drilling a directional well, it is common practice to employ a downhole drilling motor having a bent housing that provides a small bend angle in the lower portion of the drill string. If the drill string is not rotated, but merely slides downward as the hole is deepened by the bit being rotated only by the motor, the inclination and/or the azimuth of the borehole will gradually change from one value to another on account of the plane defined by the bend angle. Depending upon the "tool face" angle, that is, the compass direction in which the bit is facing as viewed from above, the borehole can be made to curve at a given azimuth or inclination. If rotation of the drill string is superimposed over that of the output shaft of the motor, the bend point will simply orbit around the axis of the borehole so that the bit normally will drill straight ahead at whatever inclination and azimuth have been previously established. The type of drilling motor that is provided with a bent housing usually is referred to as a "steerable system". Thus, various combinations of sliding and rotating drilling procedures can be used to control the borehole trajectory in a manner such that eventually it will proceed to a targeted formation. Stabilizers, a bent sub, and a "kick-pad" also can be used to control the angle build-up rate in sliding drilling, or to ensure the stability of the hole trajectory in the rotating mode.

When the above-mentioned MWD system is used in combination with a drilling motor, the tool is located a substantial distance above the motor and drill bit. Including the length of a non-magnetic spacer collar and other components that typically are connected between the tool and the motor, the MWD tool may be positioned as much as 40–200 feet above the bit, which necessarily means that the tool's measurements are made a substantial distance off-bottom. Although such location is quite adequate for many drilling applications, there are several types of directional wells where it would be highly desirable to make the measurements much closer to the bit.

For example, where a plurality of "long reach" well bores are being drilling from a single offshore platform, each well bore is started out substantially vertically and then curved outward toward a target. After being curved, the well bore is drilled along a long, straight path that is tangent to the curve until it reaches the vicinity of the target. There, the borehole is curved downward and then straightened so that it crosses the formation in either a substantially vertical direction or at a low angle with respect to vertical. In this type of directional well, the bottom section of the hole can be horizontally displaced from the top thereof by many hundreds and even thousands of feet. The drilling of the two curved segments, as well as the extended reach inclined segment, must be carefully monitored and controlled in order that the location where the hole enters the formation is as planned. Near bit measurements would allow early monitoring of various characteristic properties of the drilled formations, and allow correction of improper well bore trajectory. Indeed, without such measurements, it may be necessary to back up and set a cement plug higher in the well bore and then drill on a corrected trajectory.

Another type of borehole where very accurate control over the trajectory of the borehole must be carefully maintained is one whose lower portion extends horizontally within, rather than vertically through, the targeted formation. It has been recognized that horizontal well completions can provide significant increases in hydrocarbon production, particularly in relatively thin formations. To insure proper drainage of the formation, it is important that the well bore stay well within the confines of the upper and lower boundaries of the formation, and not cross either boundary. Moreover, the borehole should extend along a path that optimizes the production of oil rather than the water which typically is found in the lower region of the formation, or gas which typically is found near the top thereof. Care also must be taken that the borehole does not oscillate, or undulate, above and below a generally horizontal path along the center of the formation, which can cause completion problems later on. Such undulations can be the result of over-corrections caused by the measurements of directional parameters not being made near the bit.

In addition to making downhole measurements such as the inclination of the borehole near the bit which enable accurate control over borehole trajectory, it would also be highly desirable to make measurements of certain characteristic properties of the earth formations through which the borehole passes, particularly where such properties can be used in connection with trajectory control. For example, identifying a "marker" formation such as a layer of shale having characteristics that are known from logs of previously drilled wells, and which is known to lie a certain distance above the target formation, can be used to great advantage in selecting where to begin curving the borehole to insure that a certain radius of curvature will indeed place the borehole within the targeted formation. A marker shale, for example, can generally be detected by its relatively high level of natural radioactivity while a marker sandstone formation having a high salt water saturation can be detected by its relatively low electrical resistivity. Once the borehole has been curved so that it extends generally horizontally within the target formation, these same measurements can be used to determine whether the borehole is being drilled too high or too low in the formation. This is because a high gamma ray measurement can be interpreted to mean that the hole is approaching the top of the formation where a shale lies as an overburden, and a low resistivity reading can be interpreted to mean that the borehole is near the bottom of the formation where the pore spaces typically are saturated with water.

The advent of extended reach and horizontally completed wells has provided geological targets that demand increased accuracy in directional drilling procedures. To provide more accurate control, it would be extremely advantageous if the downhole measurements could be made as near to the bit as is practically possible to gain information at the earliest point in time on which trajectory change decisions could be made. However, since the lower section of the drill string is typically crowded with a large number of components such as a drilling motor power section, bent housing, bearing assemblies and one or more stabilizers, the provision of a sensor sub near the bit which houses a number of rather delicate measuring instrumentalities has not yet been accomplished for several reasons. For example, there is the problem of telemetering signals that are representative of such measurements uphole in a practical and reliable way, particularly if a mud pulse telemetry system was used where the pulses would have to pass through the power section (rotor/stator) of a downhole drilling motor.

The present invention is directed to a sensor sub or assembly that is located in the drill string very near to the bit, and which includes various transducers and other means for measuring variables such as inclination of the borehole, the natural gamma ray emission and electrical resistivity of the formations, and variables related to the performance of the mud motor. Signals representative of such measurements are telemetered uphole a relatively short distance to a receiver system that supplies corresponding signals to the MWD tool located above the drilling motor. The receiver system can either be connected to the MWD tool or be an integral part thereof. The MWD tool then relays the information to the surface where it is detected and decoded substantially in real time.

An MWD system disclosed in U.S. Pat. No. 4,698,794, detects the rotation rate of the shaft of a downhole turbine and converts this measurement into a series of high frequency pressure pulses in the mud flow stream inside the collars above the turbine. These pulses are detected by a pressure transducer in an MWD tool located further above the turbine, and the MWD tool then transmits related pressure pulses at a lower frequency to the surface. Although this patent suggests the use of a telemetry system having lower and upper transmission channels, the sensor for detecting the turbine rpm and the means for producing pressure pulses is located near the top of the drilling motor, and thus is a substantial distance above the bottom of the borehole. This patent also fails to teach or suggest any means by which important borehole parameters, or any geological characteristics of the formations, might be measured below the MWD tool.

In light of the above, a general object of the present invention is to provide methods and apparatus for making near-bit measurements that can be used to accurately control the directional drilling of a well bore.

Another object Of the present invention is to provide a measuring-while-drilling system where measurements made near the bit are telemetered uphole to another telemetry system which relays signals to the surface that are representative of such measurements.

Still another object of the present invention is to provide a sensor sub of the type described which measures borehole trajectory parameters as well as certain geological formation characteristics which aid in maintaining accurate control over the direction of a well bore so that it can be made to penetrate and remain within a targeted formation.

Yet another object of the present invention is to provide a sensor sub of the type described which measures borehole trajectory parameters and certain geological formation characteristics which aid in maintaining accurate control over the direction of a well bore so that it can be properly curved and then extended within a targeted region of an earth formation.

Another object of the present invention is to provide certain azimuthally focused measurements which are used to ensure proper diagnosis of a change in direction that is needed to correct an improper wellbore trajectory. For example, when the drilling of a horizontal wellbore that extends into a hydrocarbon-bearing sandstone reaches a shale strata, the geological measurements made with the near-bit sensors will detect the transition and can be used to determine whether the well trajectory should be corrected upward or downward since such azimuthally focused measurements will show whether the shale layer is above or below the sandstone layer.

Another object of the present invention is to provide a sensor sub of the type described that measures downhole equipment parameters such as motor shaft RPM which enable a continuous monitor of the drilling process, for example respecting wear of the motor stator, optimum weight-on-bit, and motor torque.

Yet another object of the present invention is to provide a sensor assembly of the type described that measures parameters such as vibration levels that may adversely affect the measurement of other variables such as inclination and lie in a regime which can produce resonant conditions that reduce the useful life of tool string components. Such measurement also can be used in combination with surface pump pressures to analyze reasons for changes in the rates at which the bit penetrated the rocks.

SUMMARY OF THE INVENTION

These and other objects are attained in accordance with the present invention through the provision of an apparatus for use in making downhole measurements during the drilling of a borehole using a downhole mud powered drilling motor that drives the drill bit. Preferably, the housing assembly of the motor is constructed or can be adjusted to provide a bend angle that causes the borehole to curve unless drill string rotation is superimposed over the rotation of the motor drive shaft, in which case the path will be essentially straight. A sensor sub housing of the present invention preferably is positioned between the upper and lower bearing assemblies at the lower end of the motor and near the bit. The sensor sub houses instrumentalities for making measurements of certain borehole parameters, motor and bit performance parameters, and various characteristic properties of the formations being drilled. Signals representative of such measurements are telemetered uphole to a receiver sub that is located in the drill string above the drilling motor. The receiver sub detects these signals and applies them to a measuring-while-drilling tool, which relays signals representative of the measurements to the surface. Locating the sensor sub between the bearing assemblies of the motor optimizes its near-bit location.

The telemetering system employed by the sensor sub produces either sonic vibrations that travel through the walls of the metal pipe members thereabove to the receiver sub, or modulated electromagnetic signals that pass through the earth formations and are picked up by an antenna at the receiver sub. The latter e-mag telemetry system is disclosed in further detail in U.S. patent application No. 786,137, filed Oct. 31, 1991, now U.S. Pat. No. 5,235,285, and assigned to the assignee of this invention. This application is incorporated herein by express reference. As noted above, the telemetering system employed by the MWD tool preferably produces pressure pulses in the mud stream inside the drill pipe and is capable of transmitting intelligible information to the surface over distances of many thousands of feet.

The geological properties measured by the sensor sub of the present invention preferably include natural radioactivity (particularly gamma rays) and electrical resistivity (conductivity) of the formations surrounding the borehole. These properties have been found to be particularly useful in identifying marker formations which enable the borehole to be properly kicked off and curved so that it will enter the target formation as planned. In the case of horizontally completed wells, these measurements also can be interpreted to insure that the borehole proceeds substantially within the targeted portion of the formation even if relatively thin. The borehole parameters that are measured by the sensor sub of the present invention include hole inclination and tool face. A continuous monitor of these downhole near-bit measurements enables corrective measures to be quickly taken if the trajectory of the borehole varies from a plan. Measurements related to motor performance and other variables also can be monitored including RPM, downhole weight-on-bit, downhole torque, and vibration levels, each of which is highly useful for the reasons stated above. In accordance with an additional aspect of a preferred embodiment of the present invention, the geological characteristic measurements can be azimuthally focused in selected radial directions to obtain measurements that also are highly useful in controlling and correcting the direction of the borehole.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF PREFERRED EMBODIMENTS

Figure 1:
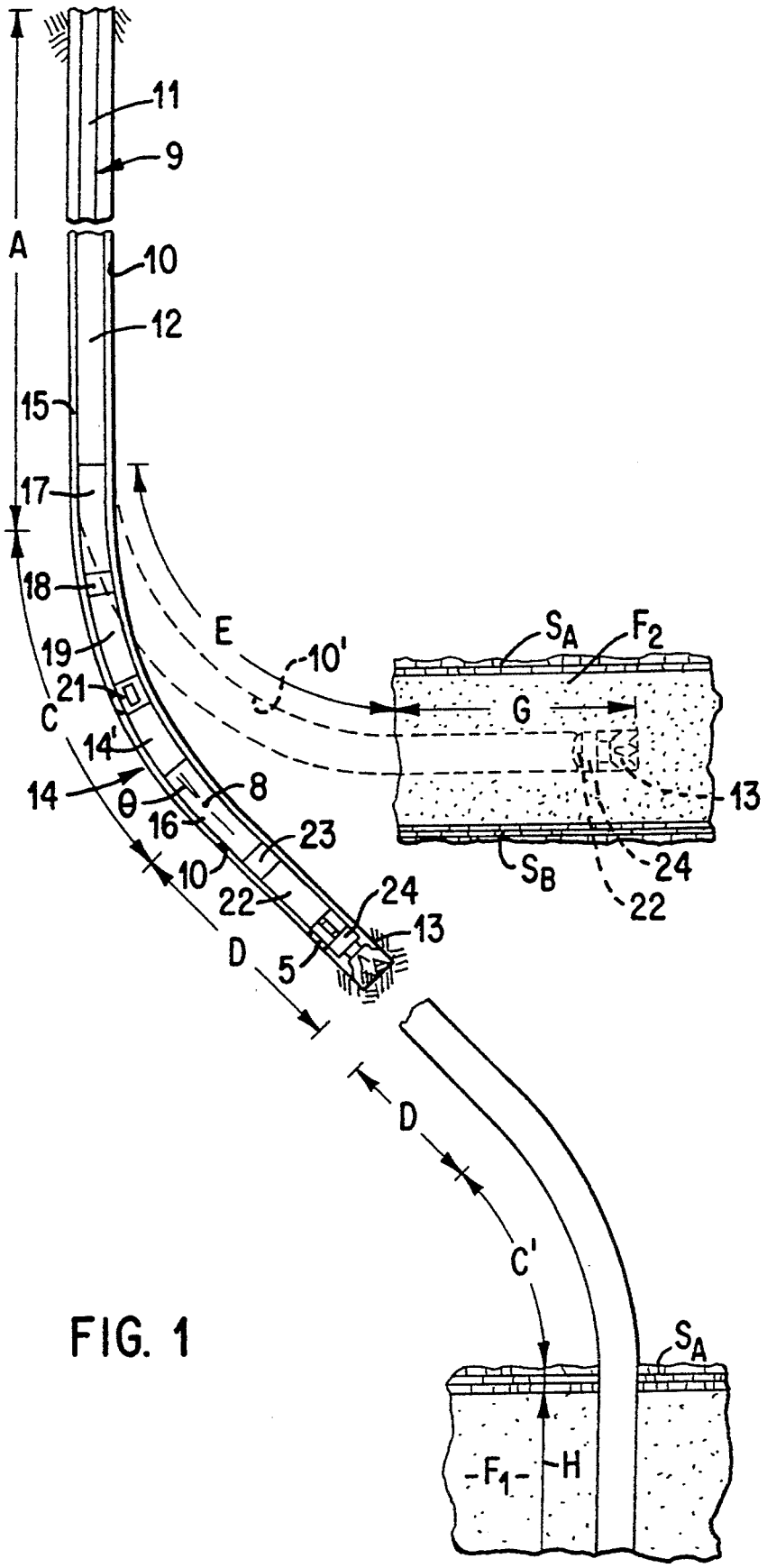
FIG. 1 is a schematic view that shows boreholes of the extended reach and horizontal completion types, with a string of measuring-while-drilling tools including those of the present invention suspended therein.

Referring initially to FIG. 1, a drill string generally indicated as 9 including lengths of drill pipe 11 and drill Collars 12 is shown suspended in a well bore 10. A drill bit 13 at the lower end of the string is rotated by the output shaft of a motor assembly generally indicated as 14 that is powered by drilling mud circulated down through the bore of the string and back up to the surface via the annulus 15. The motor assembly 14 includes a power section 14' (rotor/stator or turbine) and a bent housing assembly 16 that establishes a small bend angle $\theta$ at bend point 8 which causes the borehole 10 to curve in the plane of the bend angle and gradually establish a new or different inclination when drilling in "sliding" mode. The motor assembly 14 also includes a sensor sub 22 of the present invention which preferably is located between the upper and lower bearing assemblies 23 and 24 which stabilize the rotation of the motor output shaft and the bit 13. As noted above, if rotation of the drill string 9 is superimposed over the rotation of the motor drive shaft, the borehole 10 will be drilled straight ahead as the bend point 8 merely orbits about the axis of the borehole. The bent housing 16 can be a fixed angle device, or it can be a surface adjustable assembly as disclosed and claimed in commonly-assigned U.S. patent application Ser. No. 722,073, filed Jun. 27, 1991, now abandoned. The bent housing assembly 16 also can be a downhole adjustable assembly as disclosed and claimed in commonly-assigned U.S. patent application Ser. No. 649,107, filed Feb. 1, 1991, now U.S. Pat. No. 5,117,927. Both of these applications are incorporated herein by reference. Alternately, the housing assembly 16 can be a fixed bent housing, or a straight bent housing used in association with a bent sub (not shown) well known in the art located in the drill string above the motor 14 to provide the bend angle.

For general reference respecting the following specification, FIG. 1 illustrates two general types of directional wellbores, the lower one being an "extended reach" type of borehole having an upper section A that is started out at the surface on the vertical and then curved in the section C to establish a certain inclination. Then the borehole 10 is drilled straight ahead at that inclination along section D over a lengthy distance to a point where the borehole is curved downward in section C' to the vertical. The vertical section H penetrates the target formation $F_1$, which for purposes of illustration is shown as a sandstone below a layer of shale $S_A$. In some cases the section H is drilled at some low angle to the vertical. The other borehole 10' shown in dash lines to the right in FIG. 1 is a type that is drilled for a horizontal completion. Here the borehole is curved in the section E to where it extends horizontally, or nearly horizontal, along the length of section G through the formation $F_2$, which for purposes of illustration is shown as a layer of sandstone having shales $S_A$ and $S_B$ respectively above and below it. This type of completion allows much improved drainage of the formation $F_2$ by reason of the significantly increased surface area of the borehole 10' that is formed in the formation. This type of borehole also can be used to intersect a large number of vertical fractures that contain hydrocarbons to provide increased production from a single borehole.

In order to telemeter information to the surface substantially in real time so that the trajectory of the borehole 10 or 10' can be closely monitored, a measuring-while-drilling (MWD) tool 17 is connected in the drill string 9 above the motor 14. This tool, as previously noted, includes various instrumentalities $S_1$, $S_2$ . . . $S_N$ which measure hole direction parameters, certain characteristic properties of the earth formations that surround the borehole 10, and other variables. A receiver sub 18 of the present invention is connected as a separate tool to the lower end of the MWD tool 17, or made as an integral part thereof. The sub 18 and MWD tool 17 preferably are separated from the drilling motor assembly 14 by a length of nonmagnetic drill collar 19 to avoid magnetic interference with azimuth measurements made by the tool 17. A stabilizer 21 of suitable construction can be connected in the string 9 above the motor 14 to substantially center the tool string in the borehole at this point, and another stabilizer 5 (typically "undergauge") can be positioned near the drill bit 13, for example on the lower portion of the sensor sub 18. The drive shaft of the motor 14 extends down through the bent housing 16 and the sensor sub 22 to where it is attached to a spindle and a bit box that drive the bit 13.

Figure 2:
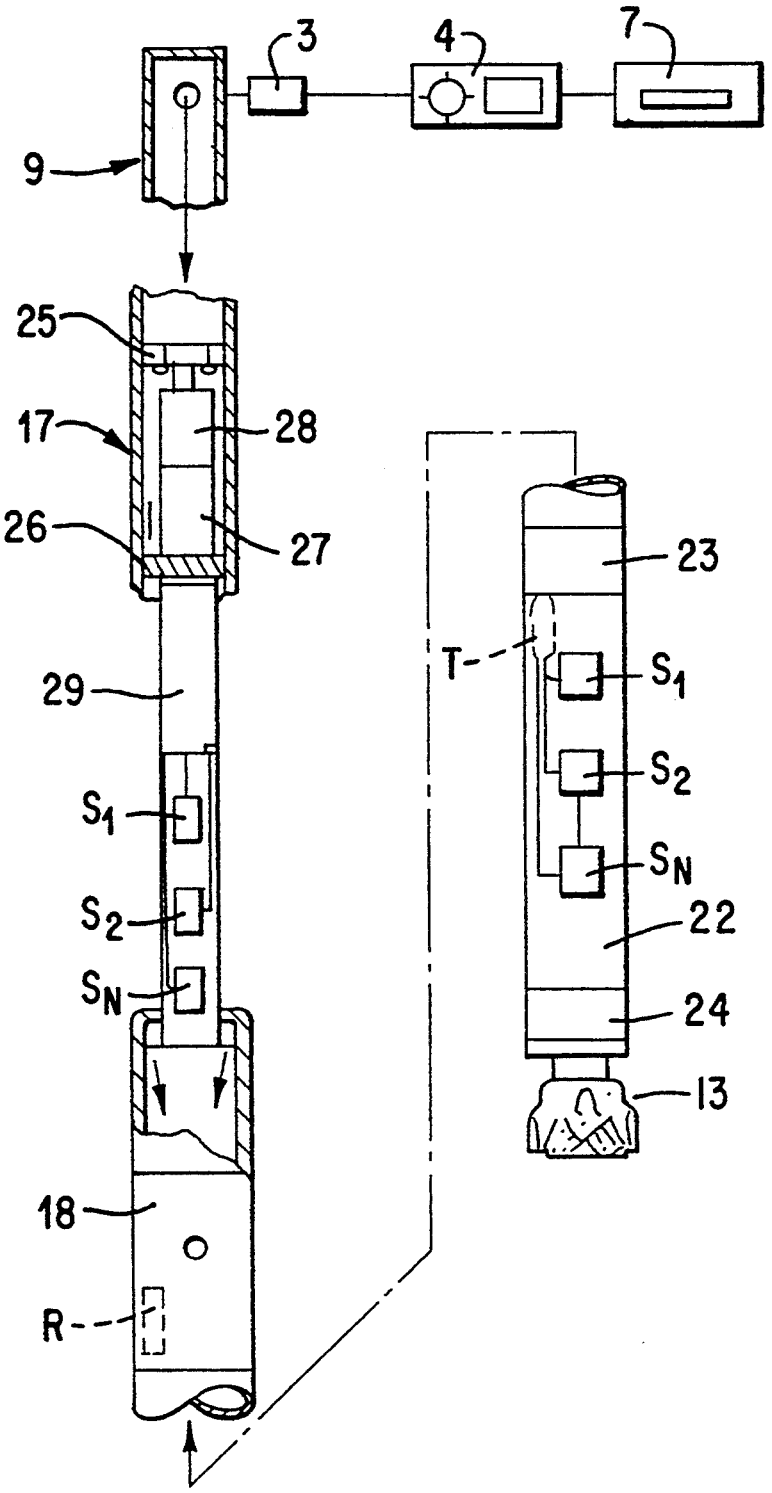
FIG. 2 is a schematic view of the combination of measuring systems used in the tool string shown in FIG. 1.

The MWD tool 17 operates to transmit information to the surface as shown schematically in FIG. 2. Drilling mud pumped down through the drill string 9 passes through a valve 25, that repeatedly interrupts the mud flow to produce a stream of pressure pulses that are detected by a transducer 3 at the surface. The signals are processed and displayed at 4, and recorded at 7. After passing through the valve 25 the mud flows through a turbine 26 which drives a generator 27 that provides electrical power for the system. The operation of the valve 25 is modulated by a controller 28 in response to electrical signals from a cartridge 29 that receives measurement data from each of the various sensors $S_1$, $S_2$ . . . $S_N$ within the MWD tool 17. Thus, the pressure pulses detected at the surface during a certain time period are directly related to particular measurements made downhole. The foregoing mud pulse telemetry technology is generally known at least in its broader concepts, so as to need no further detailed elaboration. One type of telemetry system commonly referred to as a "mud siren" is described in U.S. Pat. Nos. 4,100,528, 4,103,281 and 4,167,000, which are incorporated herein by reference. Of course, other types of mud pulse telemetry systems, such as those that produce positive pulses, negative pulses, or combinations of positive and negative pulses, also may be used. The principle advantage of a mud pulse system is that information can be telemetered from downhole over a distance of many thousands of feet and reliably detected at the surface.

Referring still to FIG. 2, the present invention in another aspect includes a combination with the MWD tool 17 of the sensor sub 22 and the receiver sub 18. The sensor sub 22 also includes instrumentalities $S_1$, $S_2$ . . . $S_N$ for measuring directional parameters and certain characteristic properties of the earth formations. In addition, measurements can be made that enable surface monitoring of drilling performance characteristics such as motor rpm and vibration. Such measurements are converted to representative electrical signals which operate a transmitter T associated with the sensor sub 22 that communicates with a receiver R associated with the uphole receiver sub 18. The mode of communication over this relatively short distance can be by way of sonic vibrations generated by a sonic transmitter that functions as transmitter T that travel through the walls of the metallic members located between the sensor sub 22 and the receiver sub 18. Alternatively, the communication can be accomplished by modulated electric currents that propagate through the formation in response to operation of an electromagnetic coil that functions as transmitter T mounted on the sensor sub 22, and which are detected by another electromagnetic coil that functions as receiver R mounted on the receiver sub 18. In either event, the signals are picked up by the receiver R at the receiver sub 18, decoded, and then relayed to the electronic cartridge 29 of the MWD tool 17. The mud pulses produced by the MWD tool 17 then relay this information to the surface which represent the various measurements made by both the sensor sub 22 and the MWD tool 17.

Figure 3A:
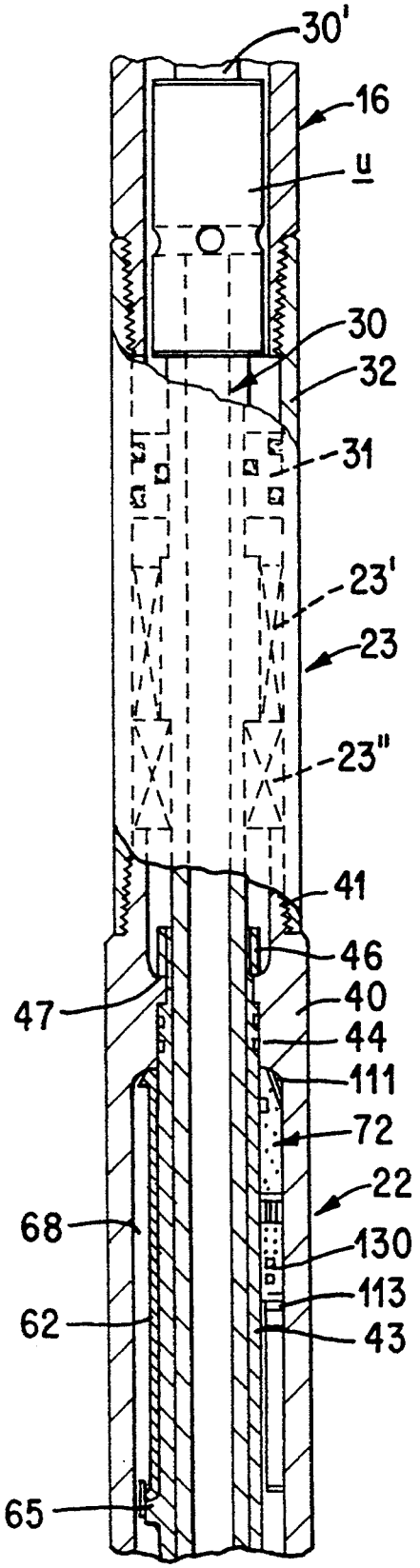
FIGS. 3A–3C are longitudinal cross-sectional views, with some parts in side elevation, of the sensor sub of the present invention being positioned near the lower end of a drilling motor, these figures providing successive continuations.
Figure 3B:
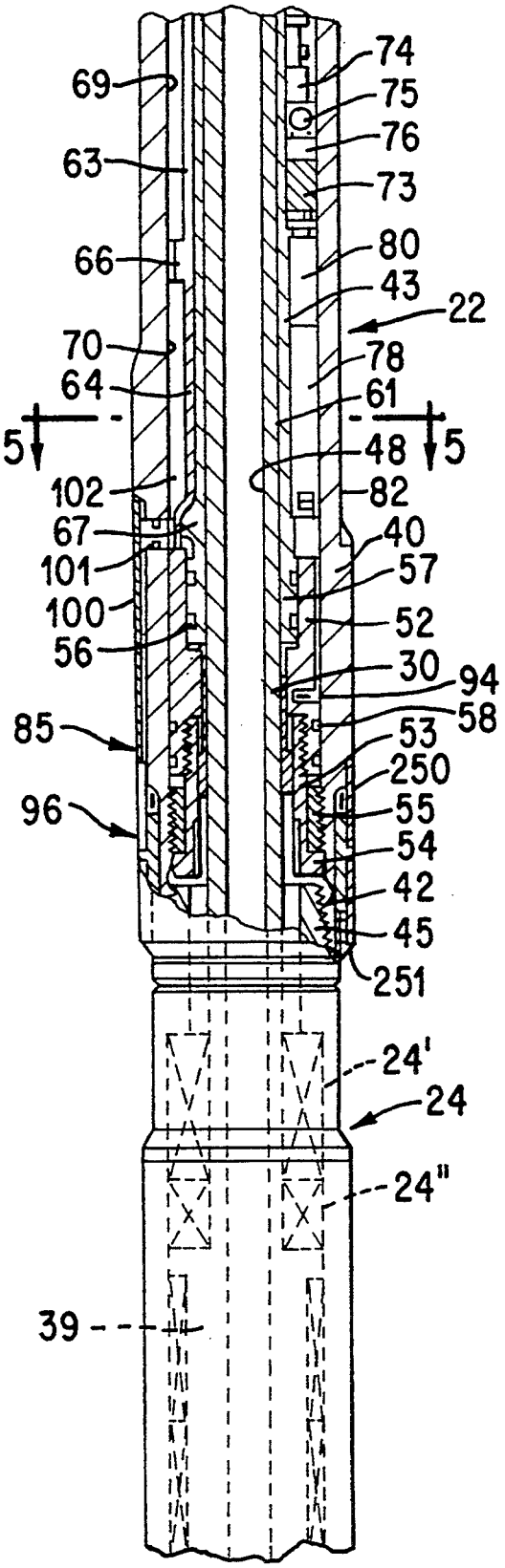
Figure 3C:
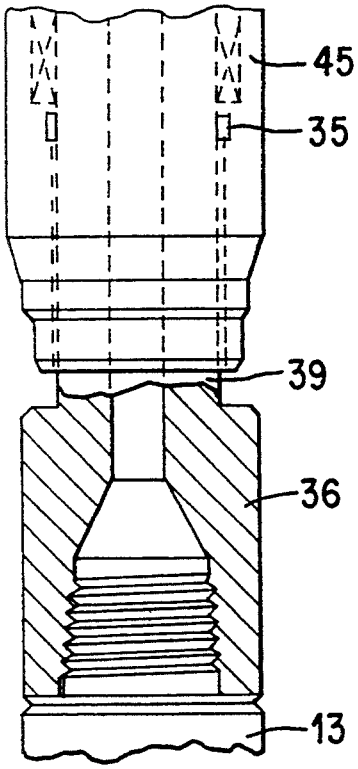

Turning now to FIGS. 3A–3C, apparatus components at the lower end of the motor assembly 14 include a drive shaft section generally indicated as 30 that is connected to the lower end of the output drive shaft 30' of the motor 14 by a cardan-type constant velocity joint U. An upper bearing assembly generally indicated as 23' having radial bearings 23' and axial bearings 23'' is located in the annular space between upper bearing housing 32 that is threaded to the lower end of the bent housing 16, and the drive shaft section 30. This space preferably is filled with lubricating oil. Means such as floating piston 31 can be provided to transmit circulation pressures to the oil in the annular space, and to compensate for volume changes of the oil on account of increased pressures and temperatures downhole. The lower bearing assembly generally indicated as 24 (FIG. 3B) includes axial bearings 24' and radial bearings 24'' and also works in a lubricating oil-filled chamber which can be communicated with the upper bearing chamber by an annular clearance space outside the drive shaft 30. The lower end of the drive shaft section 30 is suitably joined to an enlarged diameter spindle 39 (FIG. 3C) whose lower end has a threaded bit box 36 to which the bit 13 is attached. A seal assembly 35 prevents drilling mud from entering the lower bearing assembly 24. The various bearing elements are shown only schematically since they form no part of the present invention.

The sensor sub generally indicated as 22 includes an outer tubular housing member 40 having a threaded pin connection 41 at its upper end which is threaded to the upper bearing housing 28, and a threaded box connection 42 at its lower end which is threaded to the lower bearing housing 45. A tubular mandrel 43 is mounted within the housing member 40 and has its upper end sealed with respect to the housing by O-ring seals 44 to prevent fluid leakage. A retainer 46 having a downward facing shoulder 47 that engages an inwardly directed flange on the housing 40 fixes the upper end of the mandrel 43 against longitudinal movement. The lower portion 57 of the mandrel 43 is received in an adapter 52 that is threaded to a jam nut 53 which has an external flange 54 that abuts a split ring 55 to lock the members together both rotationally and longitudinally. The split ring 55 engages threads on the lower end of the housing member 40 as shown in FIG. 3B, and seal rings 56 and 58 prevent fluid leakage. The drive shaft 30 extends through the bore 61 of the mandrel 43, and on downward to where its lower end is attached to the spindle 39. The throughbore 48 of the shaft 30 provides the flow path for drilling mud to the bit 13. The annular clearance between the outer walls of the drive shaft 30 and the inner walls of the mandrel 43 also can be filled with a lubricant such as oil to communicate the oil chambers for the bearing assemblies 23 and 24.

The outer wall of the mandrel 43 is laterally spaced from the inner wall of the housing 40 to form a plurality of elongated annular cavities. A series of shell members 62, 63, 64, are located in the cavity and their opposite ends are secured to respective outwardly directed flanges 65, 66, 67 on the mandrel 43 to mount various items such as sensors, circuit boards, batteries and the like in the annular cavities 68, 69, 70. By virtue of the sealing at the upper and lower ends of the mandrel 43 with respect to the housing 40, all of these cavities contain air at essentially atmospheric pressure. The tipper cavity 68 houses a sonic transmitter generally indicated as 72 that will be described later herein in detail, and most of the circuit boards. The cavity 69 houses three accelerometers 74–76 (FIG. 3B) which are mounted on orthogonal axes so as to measure three components of the earth's gravity field, as well as batteries 73. The lower cavity 70 houses a scintillation crystal 78 that detects gamma rays which emanate naturally from the formations adjacent the borehole 10, and an associated photomultiplier tube 80 that provides an output signal. Associated circuit boards also are located in the cavity 70.

Figure 4:
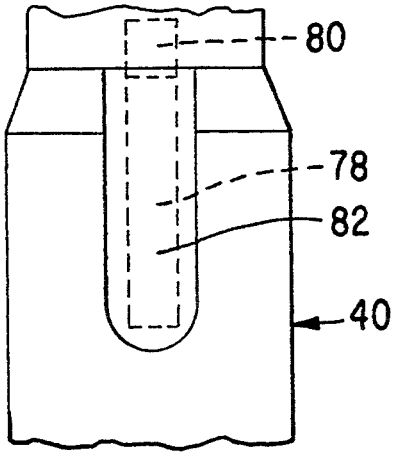
FIG. 4 is a partial outside view the sensor housing at the level of the gamma ray detector.
Figure 5:
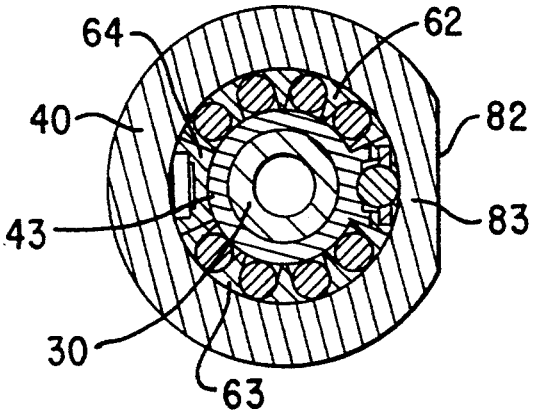
FIG. 5 is a cross-sectional view on line 5—5 of FIG. 3B.

In a preferred embodiment, longitudinal recess 82 is provided on the outer surface of the housing member 40, as shown in FIGS. 4 and 5, and is located generally coextensive with the scintillation crystal 78, which provides a wall section 83 of reduced thickness. In this manner, there is reduced attenuation of the gamma rays coming in from the outer side of the crystal 78. However, for gamma rays coming from the back side, the attenuation is high due to absorption in the thick walls of the housing 40, the mandrel 43 and the drive shaft 30. Thus, the gamma ray measurements of the detector 78 can be considered to be azimuthally focused in a direction that is generally radially outward of the longitudinal recess 82.

To measure the electrical resistivity of the various formations through which the bit 13 drills, the sensor sub 22 of the present invention is preferably provided with electromagnetic means indicated generally at 96 in FIG. 3B. As shown in more detail in FIG. 6, means 96 includes a pair of electromagnetic coil assemblies 250 and 251 that are mounted in an external annular recess 252 on the outside of the sensor sub housing 40. Each coil assembly includes a high magnetic permeability, thin metal ring 253 which provides a core that is encased in an annular body of insulation 254. A number of turns of insulated conductor wire is wound on each ring 253, and the two ends of each coil extend upward through a groove under a cover plate 100 as shown in FIG. 3B and are brought into the internal cavity 70 of the sensor sub 22 via a high pressure feed-through connector 101. When alternating electrical current is sent through the turns of the upper coil assembly 250, a changing magnetic field is created which generates alternating current flow in the axial direction through the walls of the housing 40. Preferably, upper coil assembly 250 is driven by a sinewave generator under a processor at a frequency on the order of 100 Hz to 1 MHz with the low kilohertz range being preferred such as 1.5 KHz. At least some of these currents eventually pass out of the housing 40 and then out into the formations via the drilling mud in the annulus 15. The current paths loop outward into the formation and then reenter the housing 40 above the upper coil 250 where it flows axially therethrough. As the currents pass through the measurement coil 251, they generate alternating magnetic fields in the ring 253 which produce output voltages across the two leads of its wire turns.

In an embodiment of the present invention that will be described later in further detail, transmitting coil assembly 250 is also employed as the transmitting coil of the local electromagnetic telemetry system either on a "time-sharing" basis with the resistivity measurement made, or simultaneously by being operated at different frequencies.

Figure 6:
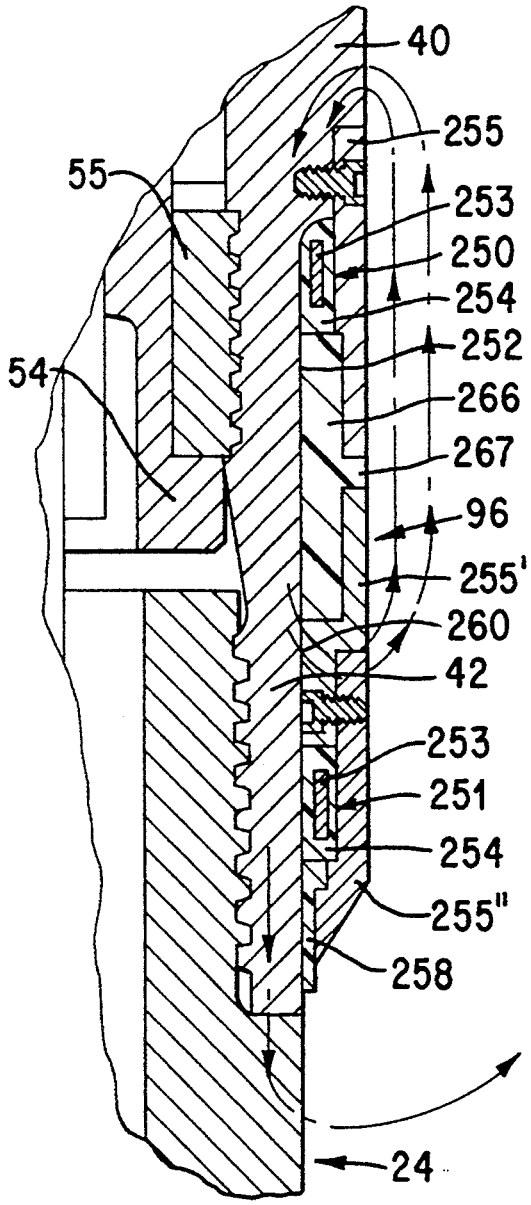
FIG. 6 is an enlarged, fragmentary cross-sectional view showing structure by which the resistivity of a formation is measured.
Figure 6A:
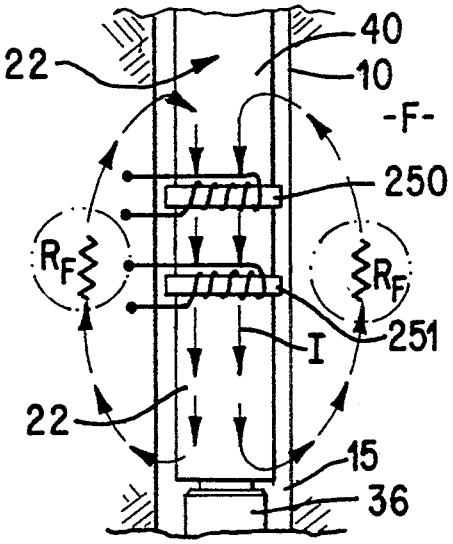
FIG. 6A is a schematic illustration of how the formation resistivity is measured with the structure shown in FIG. 6.

FIG. 6A further illustrates schematically the measurement of formation resistivity made by the sensor sub 22 of the present invention. As noted above, when transmitter coil 250 is energized with an alternating current, currents I are induced to flow axially through the steel walls of the housing 40. The currents exit the housing as shown by the arrows and loop outward through the formation F. Some of the currents return to the housing 40 of the measuring sub 22 above the transmitter coil 250 and again flow axially in the housing, so that the currents flow in a circulating manner as shown, so long as the coil 250 is being energized. The measurement coil 251 is energized by such currents, and voltages are produced across the leads of its wire turns. The electrical resistivity of the formation F to such current flow is indicated symbolically as $R_F$. By comparing the currents that are induced in the housing 40 by operating the transmitter coil 250 to the returning currents that are sensed by the measurement coil 251, a measure of the formation resistivity, typically in units of ohm-$m^2$/m (or simply ohm-meter) is obtained. In reality, the currents leave the housing 40 of the sensor sub 22 at various surfaces including below the coil 251 as well as at the bit box 36 and the bit 13, and loop back through the formation F over increasingly longer loop paths. For purposes of analysis, the paths can be considered to be along laterally spaced, equipotential surfaces that do not cross one another. The resistivity that is encountered by currents which travel over the longer looping paths necessarily is at a greater depth of investigation into the formation F.

To ensure that some of the currents generated by the coil 250 are forced to flow axially through the walls of the housing 40 to where they exit at more remote points below the coil 251, and thus pass more deeply into the formation, sensor sub 22 is preferably provided with an insulation and protection sleeve system as shown in FIG. 6. In accordance with this feature of the present invention, the coil assemblies 250 and 251 are protected by metal sleeves 255, 255', 255'', which are attached to the housing 40 by a number of fasteners such as cap screws as shown. A sleeve of insulation material 266 is positioned underneath the respective lower and upper portions of the sleeves 255 and 255', and thus is positioned between the coils 250 and 251. The sleeve 266 has an outward directed flange 267 that insulates the opposed ends of the metal sleeves 255 and 255' from one another. Another insulator sleeve 258 is located between the lower end portion of the lower sleeve 255'' and the outer surface of the housing 40. The insulator sleeves 266, 258 can each be made of a suitable insulating material such as fiberglass-filled epoxy. However, a portion of the currents generated by operation of the upper coil 250 are permitted to pass out into the annulus 15 via the lower portion 260 of the sleeve 255' and the upper section 260' of the lower sleeve 255' as shown by dash-dot-dash lines and arrow heads. These currents flow primarily through the mud in the annulus 15 (if conductive) and then reenter the housing 40 just above the coil 250. Some of these currents also may pass through a limited radial thickness of the adjacent formations. These currents are not used in determining formation resistivity, but instead function in the nature of a system employing a "guard" electrode which forces other currents which pass out of the housing 40 below the lower insulator sleeve 258, as shown, to loop more deeply out into the formation and thereby provide more meaningful resistivity measurements. It has been found that the coil assemblies 250 and 251, arranged and insulated as shown, can be placed as close together as within about 5 inches from one another and provide resistivity measurements with sufficient insensitivity to fluids in the borehole. This embodiment of the present invention also has the advantages of improved reliability and simplicity because both of the coil assemblies are mounted in the same sub, rather than being spaced far apart on separate subs.

When the drilling process uses an oil-based mud which is essentially non-conductive, the currents leave the housing 40 by virtue of direct contact between components of the drill string and the formation, typically at the near-bit stabilizer 5 shown in FIG. 1, and at the drill bit 13. Of course, if very little of these currents returns to the housing 40, then the surrounding formations are highly resistive; if much of these currents returns, then the surrounding formations have a low resistivity.

Figure 7A:
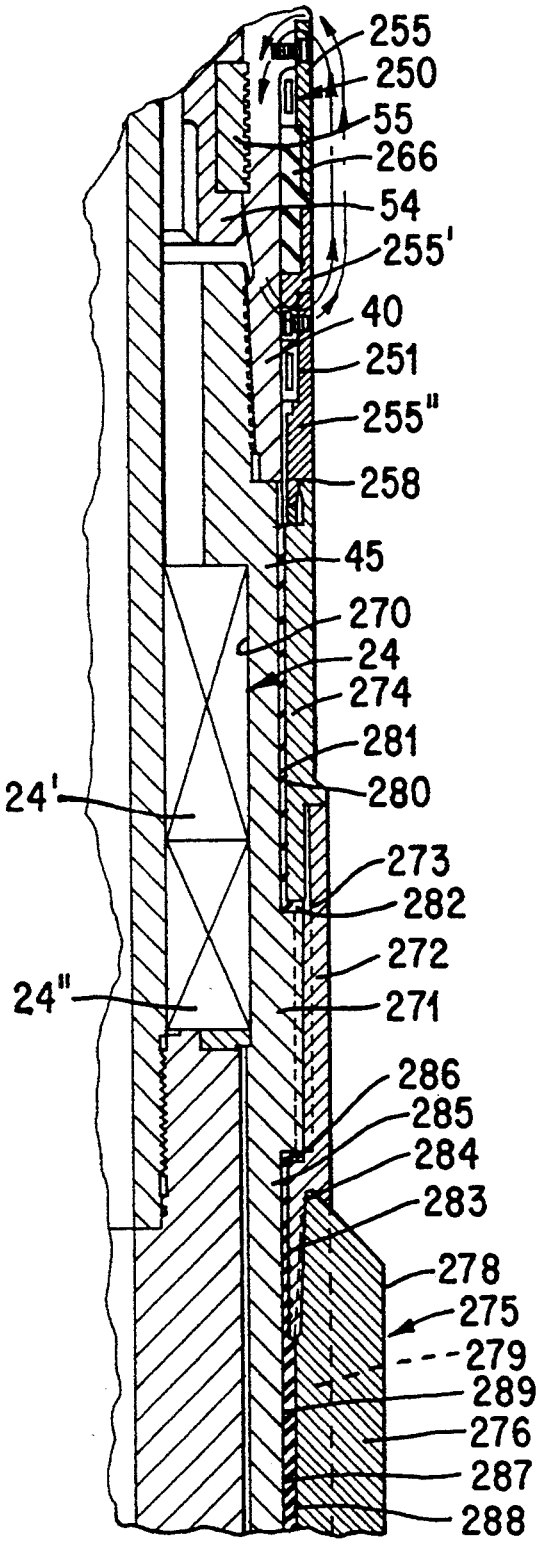
FIGS. 7A and 7B are longitudinal, quarter sectional views of another embodiment by which formation resistivity is measured in accordance with an embodiment of the present invention.
Figure 7B:
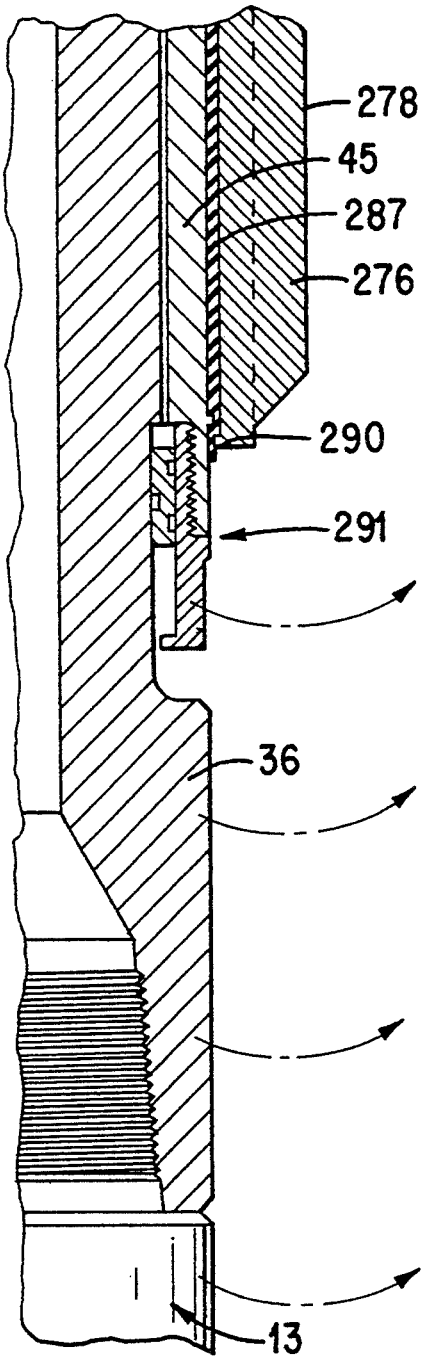

Another embodiment for making resistivity measurements in accordance with the present invention is illustrated in FIGS. 7A and 7B. The two electromagnetic coil assemblies 250, 251, the protective sleeves 255, 255', 255'', and the insulator rings 266 and 258 are essentially identical to that previously described with respect to FIG. 6, and thus are given the same reference numbers. The lower bearing housing 45 which has an internal annular recess 270 that receives an assembly of axial and radial thrust bearings 24', 24'', is provided with an outwardly directed flange 271 that has external grooves which receive for one or more keys 272 (shown in dotted lines). The keys 272 fit into internal grooves in an adapter collar 273 to lock the members against relative rotation. The upper end of the collar 273 is threaded to an upper sleeve 274, and its lower end is threaded to a stabilizer 275 which has a plurality of circumferentially spaced blades 276 that project radially outward from a tubular member 279.

To force some of the electrical currents which pass axially through the wall of the housing 45 below the lower coil 251 to remain in such wall until they are permitted to exit at the very lowermost end portion of the housing 45, as well as out of the bit box 36 and the bit 13, a combination of insulator means is employed. In addition to the sleeves 266 and 258 as previously described, another sleeve of insulation 280 is positioned between the inner walls of the upper sleeve member 274 and the outer walls 281 of the housing 45, and a thin plate or ring 282 of insulation material is located at the lower end of the upper sleeve member 274. Another sleeve 283 of insulation is located between the inner walls of the threaded pin 284 and the walls 285 that underlie it. A ring of insulation 286 is located between the pin 284 and the lower end of the flange 271, and another sleeve 287 of insulation is mounted between the inner walls 288 of the stabilizer 275 and the outer walls 289 of the housing 45. Insulation sleeve 287 has a lower end portion 290 of reduced diameter at the lower end of the stabilizer 275.

The flange 271 whose grooves carry the keys 272 has its external wall surfaces coated with a layer of non-conductive material that substantially prevents the electrical currents from exiting at this juncture. The keys 272 also are coated with an insulative material. Thus, some of the currents that flow axially through the walls of the housing 45 below the lower coil 251 as a result of operation of the transmitter coil 250 can pass out into the well annulus and the formations only at the lowermost, relatively short section 291 of the housing 45 as shown in FIG. 7B, as well as out of the walls of the adjacent bit box 36 and the bit 13. In this manner, the elements 291, 36 and 13 jointly become the measuring electrode for the system. Other of the currents which flow axially through the housing 40 are permitted to exit through the overlapping portions of the metal sleeves 255' and 255''. These currents loop upward and return to the housing 40 primarily through the drilling mud in the annulus 15, and thereby provide a "guard" electrode arrangement as previously described. The flow of these currents as shown in dash-dot-dash lines in FIG. 7A insures that the returning currents which are detected by the antenna coil 251 are those currents which are emitted at the housing portion 291, bit box 36 and the bit 13. Since these currents have passed through the formation at much greater radial depths of investigation, a meaningful measure of true formation resistivity can be obtained.

Figure 9:
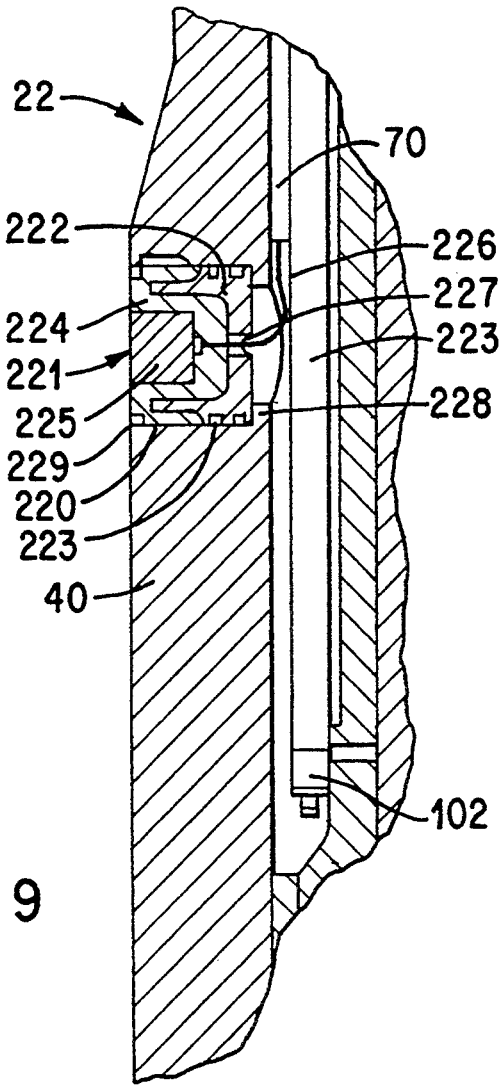
FIG. 9 is an enlarged, fragmentary cross-sectional view similar showing a transducer to measure vibration levels, and an electrode used in making azimuthal measurements of resistivity.

In another embodiment of the present invention, another resistivity measurement is made that is azimuthally and radially focused. Referring to FIG. 9, a radial bore 220 is formed through sensor sub outer housing 40 on the side diametrically opposite the scintillation detector 78 (although it could be at another angular location). The bore 220 receives a plug-type electrode assembly generally indicated as 221 that includes a metal body 222 carrying seal rings 223 which prevent fluid leakage. An elastomer insulator boot 224 is bonded to the body 222, and has an external recess that receives an electrode 225. The body 222 abuts a shoulder 228 at the rear of the bore 220, and a snap ring 229 can be used to hold the assembly in place. A lead wire 226 which is connected to the back of the electrode 225 is extended via a high pressure seal 227 into the annular cavity 70 to where it is connected to appropriate circuits. Electric currents flowing through the formation adjacent the electrode assembly 221 by virtue of the operation of coil 250 enter the electrode 225 and the wire 226, which are then processed by suitable circuits to measure resistivity. Thus, the electrode assembly 221 provides an azimuthal measurement of resistivity generally radially outward thereof, rather than an annular measurement, which is highly useful in connection with the drilling of a horizontal-type completion wellbore as discussed earlier herein. This is because the sensor sub 22 can be slowly rotated in the borehole by the drill string 9 to various angular positions with the electromagnetic current transmitter 250 in operation, and briefly halted at each position so that the electrode assembly 221 can detect if there is a higher or lower resistivity reading in any particular azimuthal direction. During such pauses in rotation the output signals from the scintillation detector 78 also can be monitored to observe whether higher or lower counts of gamma rays are coming from a certain radial orientation, so that measurements of resistivity and gamma rays can be considered together for diagnostic purposes. Further details of the resistivity measurement made with electrode assembly 221 are described in commonly-assigned U.S. patent application Ser. No. 07/786,137, filed Oct. 31, 1991, now U.S. Pat. No. 5,235,285, which again is incorporated herein by reference.

Figure 8:
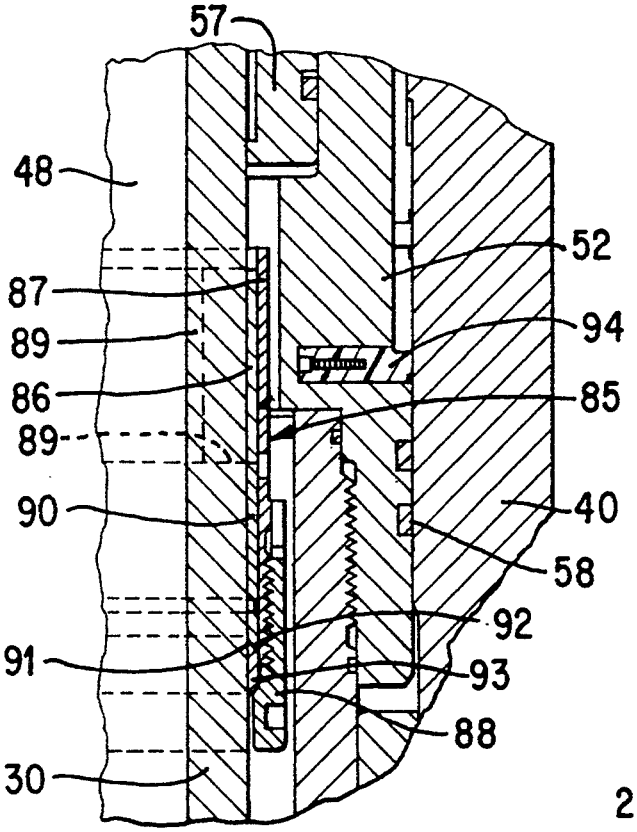
FIG. 8 is an enlarged, fragmentary cross-sectional view of the transducer assembly for measuring motor shaft rpm.

To measure a motor performance characteristic such as the rpm of the drive shaft 30 of the motor 14, a magnetic assembly indicated generally at 85 in FIG. 3B is fixed to the exterior of the drive shaft 30 and cooperates with detectors that are mounted on the adapter sub 52. As shown in enlarged detail in FIG. 8, the assembly 85 includes a pair of oppositely disposed magnets 86 mounted in windows 89 in the upper portion of an inner sleeve 90. The sleeve 90 is mounted within an outer sleeve 87 that is threaded to a nut 88. The sleeve 90 has an inclined lower end surface 91 that engages a companion inclined end surface 92 on a split friction ring 93. A lower outer surface of the ring 93 also is inclined and engages a companion inclined surface on the nut 88. The assembly 85 can be readily slipped onto the shaft 30 and given a proper longitudinal position, after which the nut 88 is tightened to cause the friction ring 93 to grip the external walls of the shaft and thereby hold the assembly 85 in place. The detectors 94 preferably are a pair of "Hall effect" devices which are mounted in the adapter 52 at an angular spacing of 90°. The detectors 94 cooperate with the rotating magnets 86 to provide an output that is representative of the RPM of the drive shaft 30.

Downhole measurement of the revolution rate of the motor shaft provides several advantages. For example, when the bit 13 is off-bottom, the rpm that results from a given flow rate of mud down the drill string 9 can be used to determine the wear of the power section 14' (rotor/stator) of motor 14 by comparing it to the rpm that should result from that flow rate through a new motor. If wear is significant, the tool string can be pulled to replace the motor. This procedure also avoids confusion that can result where it is uncertain whether the drilling is in hard rock, or is with a worn stator. Moreover, a monitor of downhole rpm while drilling can be used to optimize the weight-on-bit. Where the WOB is too high, too much torque is required which slows down the rpm of the motor and results in a high rate of wear of its stator. For optimizing the drilling process in the sliding mode of a directionally drilled well, making a downhole measurement of rpm of the motor shaft is important because the transfer of surface WOB and torque to the downhole tool string is not necessarily predictable, due to friction of the tool and pipe string with the borehole walls. In this case the drilling can be performed while monitoring the surface pump pressure, which is an indirect measure of the motor torque. Also, in a particularly preferred embodiment of the present invention, the battery power supply in the sub 22 can be switched off during periods where no rpm is detected by the rpm sensor 85, or within a few seconds after any observance of any rpm is detected. This feature conserves the energy of the batteries and extends their downhole life. Although this circuit is not shown in detail in the drawings, it includes a transistor gate which does not conduct unless an output signal from the rpm sensor 85 is applied to it.

In addition to the measurement of motor shaft rpm, a vibration sensor 102 is mounted at the lower end of the internal cavity 70 of the sensor sub 22 as shown in FIG. 9. This transducer includes a piezoelectric crystal which senses vibration frequency and amplitude along its radial sensitive axis, so that this measurement also can be telemetered continuously to the surface. Downhole measurement of vibration is important because this data in combination with other variables such as bit torque in relation to surface pump pressures, motor shaft rpm, superimposed drill string rpm, and the rate of penetration of the bit, cumulatively can provide an answer to why there has been a change in the rate of penetration. When drilling in hard rock with a good bit, one can reasonably expect there to be high torque, lower shaft rpm, high vibration and a low rate of penetration, whereas in soft rock with a good bit there should be low torque, high shaft rpm, low vibration, and a high rate of penetration. When drilling a soft rock with a worn bit, there will be low torque, high rpm, low vibration and low rate of penetration. On the other hand when drilling a hard rock with a worn bit, there will be medium torque, medium rpm, low vibration and low rate of penetration. Thus where the rate of penetration changes, the foregoing variables including the downhole measurement of vibrations can be analyzed to determine the probable reason for such change, and whether corrective action is needed. In addition, it also is possible to detect from the downhole vibration measurement when the bit has experienced one or more broken teeth on its cones since the measurement is likely to show a cyclical pertebation in the measurement.

Vibration levels also may be logged as the borehole is deepened to provide indications of rock density, hardness, or strength. Such measurements also provide an important diagnostic respecting other measurements, since if the level of vibration is too high, the inclination measurements made by the accelerometers 74–76 could be of poor quality, so that drilling procedures can be altered to obtain more reliable data. For example, the directional survey made by the accelerometers 74–76 can be made with mud circulation temporarily stopped so that the background is quiet.

Figure 10:
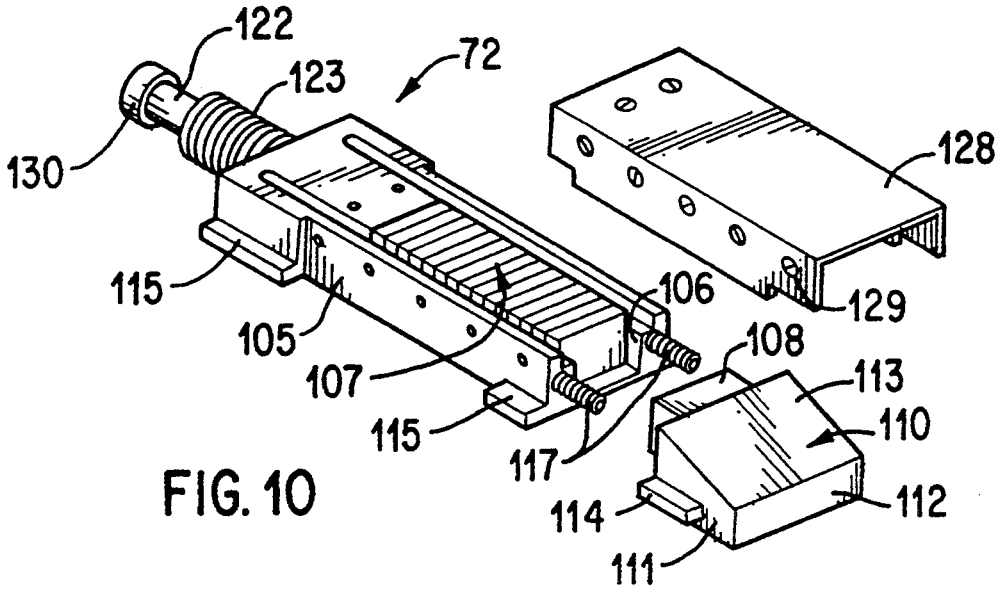
FIGS. 10 and 11 are respective exploded isometric and top views of a sonic vibration transmitter.
Figure 11:
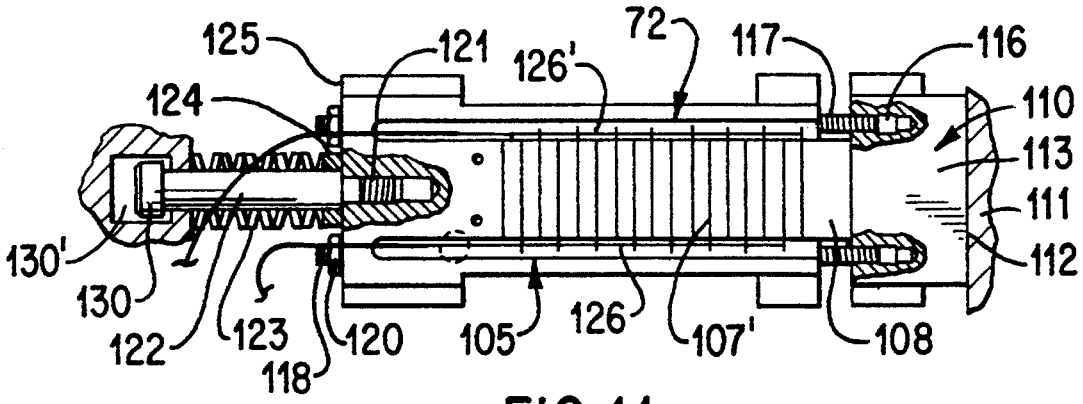

With reference to FIGS. 10 and 11, an embodiment of a sonic transmitter 72 mentioned earlier herein by which the various measurements discussed above are transmitted uphole to a receiving transducer R in the receiver sub 18 (FIG. 2), and thus to the MWD tool 17, is shown. In FIGS. 10 and 11, sonic transmitter 72 includes a generally rectangular block or body 105 that defines a longitudinal recess 106 in which is mounted a number of ceramic crystals 107 that are stacked side-by-side. The outer end of the recess 106 receives the boss 108 on the rear of a coupling block 110 which has side wall surfaces 111, an end surface 112 a top surface 113. Guide flanges 114 extend outward on the sides 111 of the block 110 and are longitudinally aligned with front and rear guide lugs 115 on the body 105. As shown more clearly in FIG. 11, threaded holes 116 are formed in the block 110 on opposite sides of the boss 108, and these holes receive the end portions 117 of a pair of threaded rods 118 which extend through holes in the body 105 that pass to the rear thereof so that nuts 120 can be employed to tighten the coupling block 110 against the stack of crystals 107. Another threaded bore 121 is formed in the center of the rear portion of the body 105 and receives a stud 122 having a plurality of relatively stiff springs, for example bellville washers 123, mounted thereon. The transmitter 72 preferably is mounted at the upper end of the internal cavity 68 in the sensor sub 22 (shown schematically in FIG. 3A) in a manner such that the front surface 112 of the coupling block 110 fits against an internal annular wall surface 111 of the housing 40. The head 130 of the stud 122 fits into a downwardly extending recess 130' with longitudinal clearance such that the spring washers 123 react between a wall surface that surrounds such recess and a washer 124 that is against the rear wall 125 of the body 105. The springs 123 hold the coupling block 110 tightly against the wall surface 111 to provide optimum sonic coupling, while allowing small dimensional changes that may occur due to high downhole temperatures. A cover plate 128 can be provided which is attached by screws 129 to the body 105.

Figure 12:
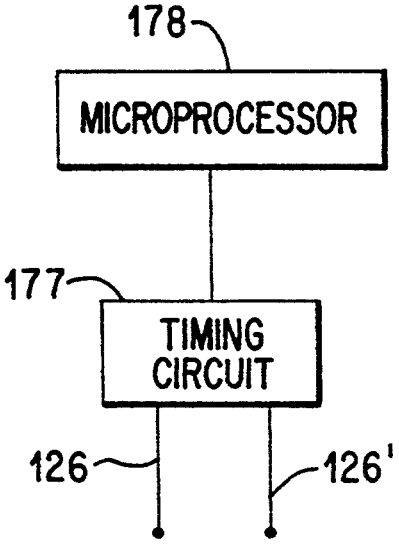
FIG. 12 illustrates schematically various electrical circuits associated with the transmitter shown in FIGS. 10 and 11.
Figure 13A:
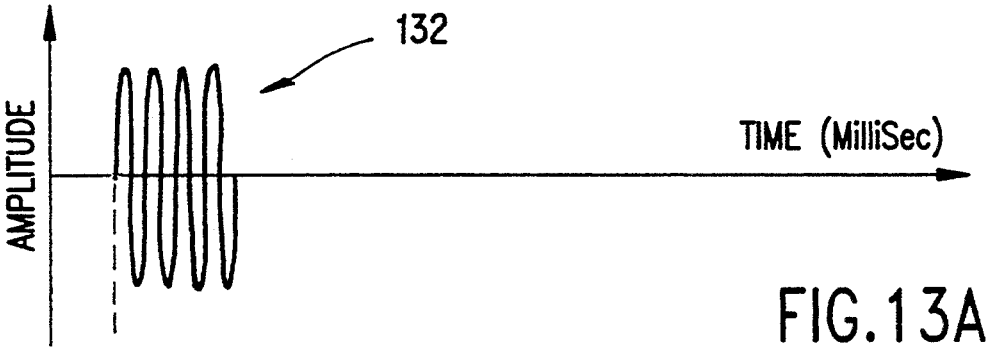
FIGS. 13A and 13B show respectively the forms of the electrical excitation of the transmitter and the sonic signals that arrive at the receiver.
Figure 13B:
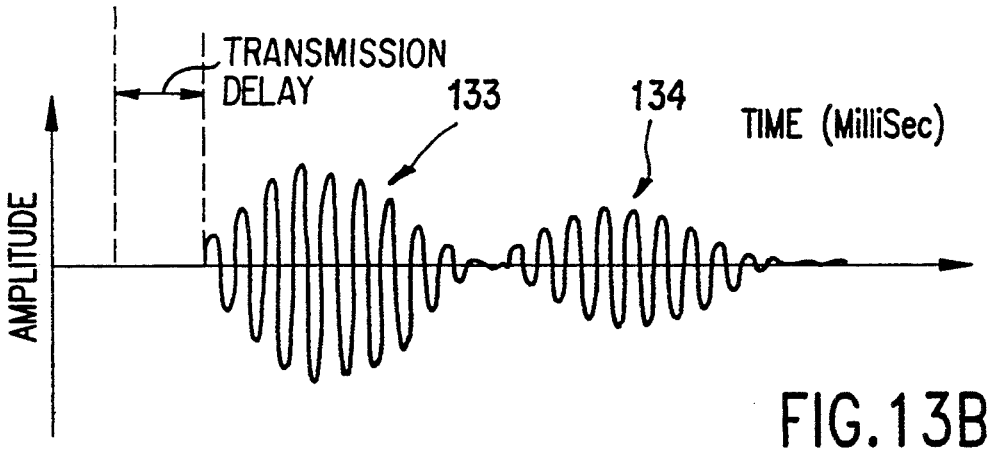
Figure 14A:
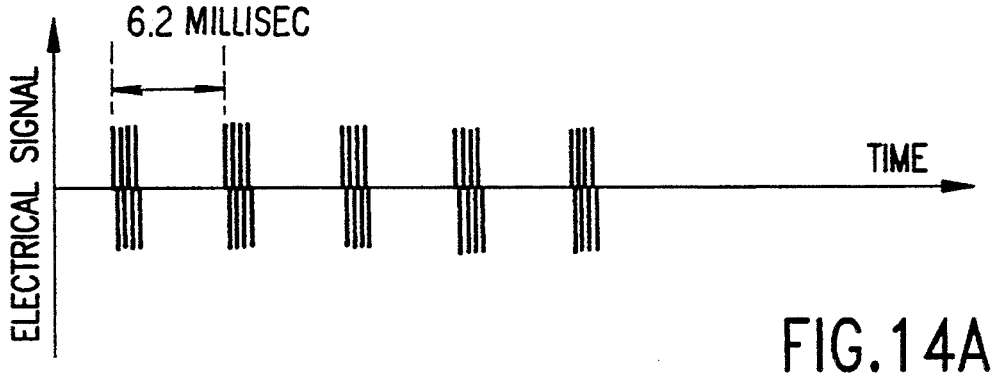
FIGS. 14A and 14B illustrate the encoding of the signals that operate the transmitter.
Figure 14B:
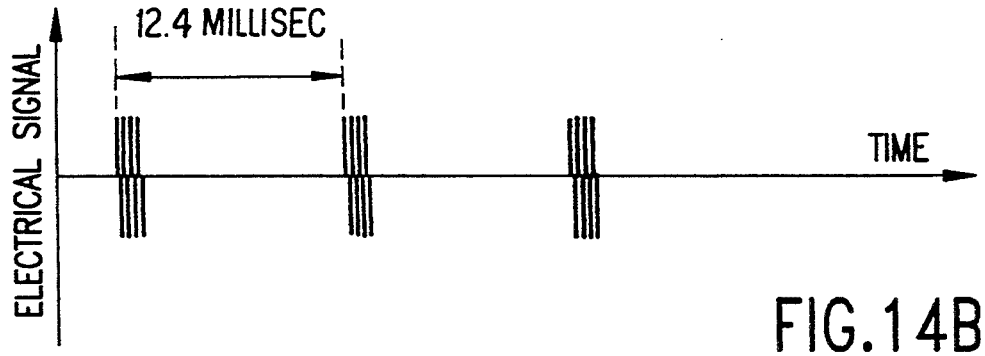

The ceramic crystals 107 are polarized and positioned so that sides of the same polarity are adjacent each other. The crystals 107 are separated by conductive sheets 107' so that voltages can be applied to each crystal. Alternating ones of the sheets 107' are connected to the negative or ground lead 126', and the balance of the sheets are connected to the positive lead 126. Voltages applied across the leads 126, 126' cause minute strains in each crystal 107 that cumulatively effect longitudinal displacements of the front end of the stack. Such displacements cause sonic vibrations to be applied via the coupling block 110 to the housing surface 111 which travel upward through the various metal members that are connected thereabove at the speed of sound in such metals. As shown in FIG. 13A, the voltages that are applied across the wires 126 and 126' preferably produce an excitation 132 having four cycles, which is a number that has been found to be optimum in the sense that maximum sonic energy is produced for a certain amount of electrical energy. This package of oscillations, called herein a "burst", generates corresponding bursts of compression waves 133 and shear waves 134 in the walls of the housing 40 as shown in FIG. 13B. After a short time delay due to travel time up the steel pipe or collar members, the sonic vibrations arrive at the uphole receiver sub 18 that includes receiving transducer R (FIG. 2). The transmitted signals can be encoded in various ways, for example digitally in terms of the repetition rate of the bursts, with a "1" bit corresponding to one, repetition rate and a "0" bit corresponding to another repetition rate. As an example, with a bit rate of 10 per second, 6.2 milliseconds can be the repetition rate for a bit 1 as shown in FIG. 14A, and 12.4 milliseconds the rate for a bit 0 as shown in FIG. 14B. As shown in FIG. 12, the voltage signals that operate the transmitter 72 are generated by a suitable microprocessor 178 and sent to a timing circuit 177 which determines the repetition rate of the bursts. The output of the timing circuit 177 is applied across the lead wires 126, 126' of the transmitter 72.

The receiver sub 18 contains a receiving transducer R (FIG. 2) which detects the vibrations generated by the transmitter 72 and generates an electrical signal in response thereto. The receiving transducer R is shown as being mounted in the lower portion of the receiver sub 18, although it could be mounted at another location therein. The receiving transducer R can be essentially the same as the transmitter transducer 72 described above and therefore need not be described in detail. The sonic vibrations in the housing walls of the receiver sub are coupled through the nose block of the receiver and strain the crystals which produce electrical output signals that are representative thereof.

Figure 16A:
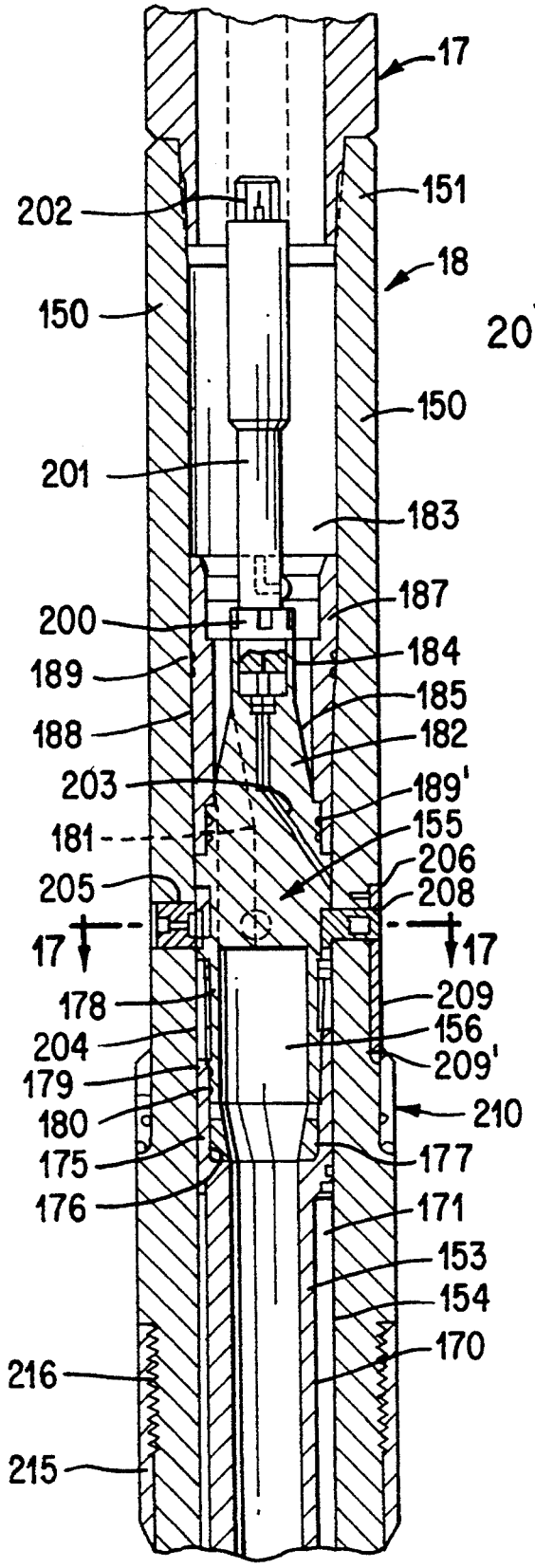
FIGS. 16A and 16B are longitudinal cross-sectional views of the receiver sub of the present invention, some parts being shown in side elevation.
Figure 16B:
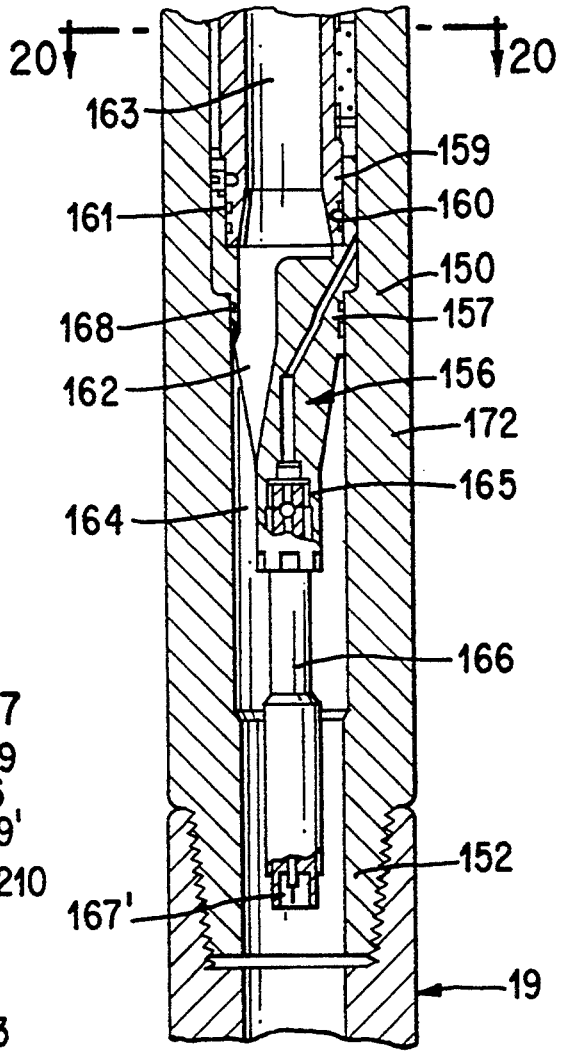
Figure 17:
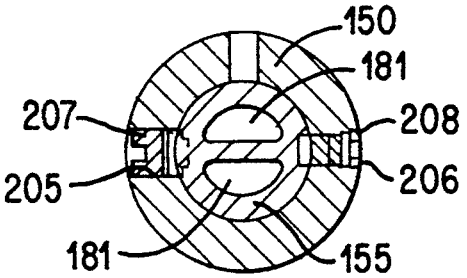
FIG. 17 is a cross-section on line 17—17 of FIG. 16A.

The structural arrangement of the receiver sub 18 in which the transducer assembly R is mounted is shown in detail FIGS. 16A and 16B. A tubular housing 150 has a threaded box 151 at its upper end which can be attached to the lower end of the MWD tool 17, and a threaded pin 152 at is lower end which can be attached to the non-magnetic spacer collar 19. Alternatively, the receiver sub 18 could be made an integral part of the MWD tool 17, but for convenience the system is disclosed herein as being separately housed. A tube 153 is mounted within the bore 154 of the housing 150 between upper and lower internal connector subs 155, 166. The lower sub 156 has a reduced diameter portion 157 that provides a shoulder 158 which engages an opposed shoulder on the housing 150 to fix its longitudinal position in the downward direction. The lower section 159 of the tube 153 is received in a counterbore 160 in the upper portion of the sub 156, and seal rings 161 prevent fluid leakage. Laterally offset passages 162, (like the passages shown at 181 in FIG. 17) divide the fluid flow coming down through the bore 163 of the tube 153 so that the flow goes around the central portion of the sub, after which the channels merge into a single flow path within the bore 164 of the housing 150 therebelow. The outer surfaces of the lower portion of the connector sub 156 preferably are tapered downward and inward to provide in a frusto-conical shape.

An electric connector assembly in the lower end of the sub 156 includes a coaxial-type female socket 165 that is arranged to accept a coaxial male plug on the upper end of a tubular extender 166 which mounts another female electrical connector 167' within the bore of the threaded pin joint 152. In this manner the connector 167' can be automatically made up with a male plug on another assembly as a threaded box is made up on the pin 152. In the embodiment shown in the drawings, the connector 167' is shown in the event it should be used in connection with another tool string component therebelow that requires an electrical hook-up; however if no such tool is being used, the assembly 167' is usually removed.

Additional seal rings 168 prevent fluid leakage between the connector sub 155 and the housing 150. The outer wall 170 of the tube 153 is laterally spaced with respect to the inner wall 154 of the housing 150 to provide an annular cavity 171 in which the receiving transducer 142 and its associated electrical circuits are mounted.

The upper section 175 of the tube 153 is counterbored at 176 to receive a sleeve 177 which directs the flow coming down through the upper connector sub 155 into the bore 163 of the tube 153. The lower end portion 178 of the sub 155 is received in another counterbore 179 in the tube 153, and is sealed with respect thereto by seal rings 180. Another pair of laterally offset flow passages 181 (FIG. 17) are formed in the upper portion 182 of the sub 155 to divert mud flow from the upper bore 183 of the housing 150 around an electrical connector assembly 184 in the upper end of the: sub 155 and then into the lower bore 156 of the sub. The outer surface 185 of the upper portion 182 tapers downward and outward to smooth the mud flow as it enters the laterally spaced flow passages 181. The assembly of connector subs 155, 156 and the tube 153 is held in position within the housing 150 by a tubular nut 187 that is threaded to the housing 150 at 188. Seal rings 189 and 189' make the parts fluid-tight. Diametrically opposed J-slot recesses or the like are provided inside the upper end of the nut 187 to enable a suitable tool to be used to install or remove the nut 187. The connector assembly 184 is made up with a companion male connector 200 on the lower end of a tubular extender 201 which has another female socket 202 on its upper end. Hereagain, the extender 201 positions the socket 202 within the bore of the threaded box joint 151 so that the socket can be mated with a companion plug on the MWD tool 17 when the joint is made up, or with any other tool immediately above the sensor sub 18. The connector can be a coaxial-type with a single center pin.

A pair of electrical conductors extend from the pin of the socket 184 down through an inclined passage 203 in the connector sub 155 and on down through an external longitudinal groove 204 on the outside of the upper portion 175 of the tube 163. The wires then enter the elongated annular cavity 171 where the receiver 142 and the various electrical circuit boards are mounted. The sockets 202, 184 and 167 all are water-proof devices having seal rings that prevent any fluid leakage therepast. Diametrically opposed bores 205, 206 are formed through the walls of the housing 150 adjacent the connector sub 155. As shown in cross-sectional FIG. 17, the bore 205 receives a blind plug 207 that can be removed at the surface to allow a readout connector (not shown) to be inserted by which data stored in any memory units in the tool can be recovered, or to test internal functions of the tool. The other bore 206 receives a high pressure feed-through connector assembly 208 which provides electrical communication between wires in the cavity 171 and the conductor wires which extend down through an external groove 209 in the body 150. A cover plate 209' is used as a protection for the wires and the connector assembly. A third bore formed at 90° to the other two bores 205 and 206 receives a pin held by a snap ring and which extends into a longitudinal groove in the member 155 to provide rotational alignment. A sleeve 215 is mounted by threads 216 on a central portion of the housing 150. The sleeve 215 protects the threads 216, and can be removed to enable a stabilizer assembly (not shown) to be threaded onto the housing 150 where the use of a stabilizer at this location is considered to be desirable.

Figure 20:
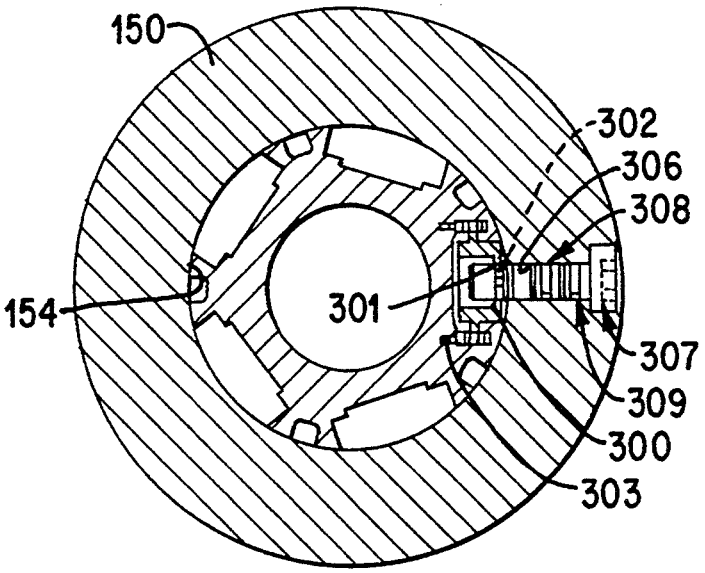
FIG. 20 is an enlarged cross-section on line 20—20 of FIG. 16B.

In another preferred embodiment of the receiver sub 18 of the present invention, a convential accelerometer is employed as the sonic receiving transducer 142. Referring now to FIG. 20 in conjunction with FIG. 16B, there is shown a carrier block 300 having a threaded hole 301 in its center and that contains an accelerometer 302, which has its sensitive axis perpendicular to the radial direction. An exemplary accelerometer is an Endevco Model 2221F. Carrier block 300 is secured to the inner wall 154 of housing 150 by fasteners 303. Housing 150 is provided with a bore 306 through which threaded stud 307 passes. The threaded end of stud 307 is threadedly engaged to threaded hole 301 of carrier block 300, and is provided with seals 308 and 309. Tightening stud 307 pulls carrier block 300 firmly against inner wall 154 of housing 150, thereby providing a good sonic connection between the two.

Figure 15:
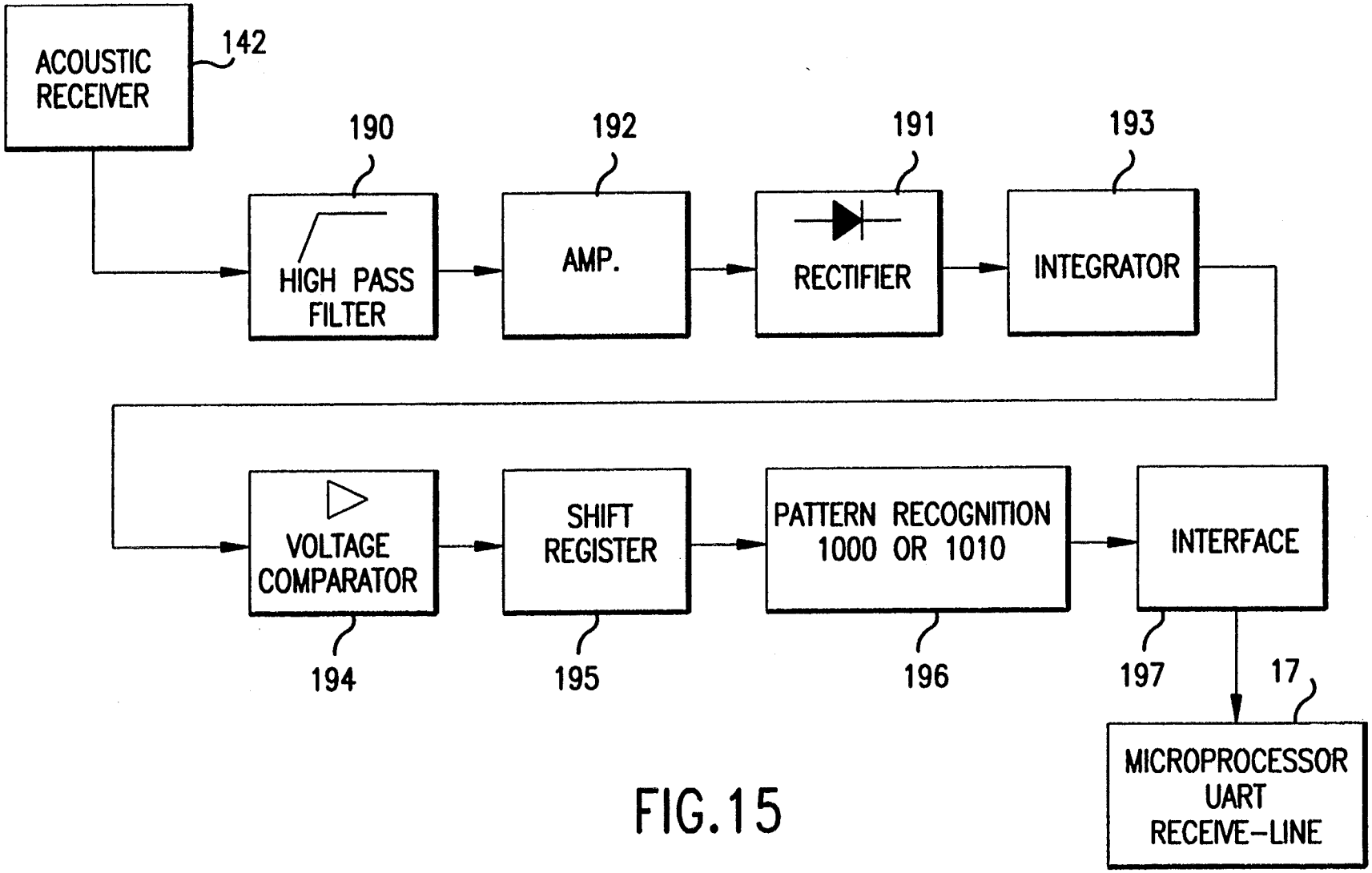
FIG. 15 is a block diagram showing the circuits used to decode the sonic signals at the receiver sub.

The output signals from sonic receiving transducer 142 in receiver sub 18 is operatively associated with the signal decoding system shown schematically in FIG. 15. The electrical output signals from receiving transducer 142 are ted to a high pass filter 190 that blocks low frequency noise signals that are typically generated during the drilling process. When the "transmitter 72" type of receiver is used, filter 190 is preferably passive and the output signal is diode clamped to avoid very large and potentially damaging voltages that can be generated by the piezoelectric crystal stack when subjected to the high shocks encountered while drilling. Otherwise, when an accelerometer is used for receiving transducer 142, a pre-amplifier is used ahead of high pass filter 190, which can be an active filter, since the signal generated by such an accelerometer is typically small. In either case, the resultant signal is then amplified at amplifier 192, rectified by rectifier 191, and integrated by integrator 193. From there, the signal is fed to a comparator 194 being supplied with a constant reference voltage for comparison, which produces a signal when the signal from integrator 193 is above a predetermined threshold. The signals from comparator 194 are received by shift register 195 at one of two rates—either 6.25 msec between bursts representing a logic bit "1", or 12.5 msec between bursts representing a logic bit "0". The shift register looks for a pattern in 12.5 msec windows and makes an inquiry at times 0 msec, 5.25 msec, 6.25 msec, and 11.5 msec. This results in 1010 being shifted into shift register 82 for a logic "1" and 1000 for a logic "0". For redundancy, this pattern is preferably repeated four times resulting in a 100 msec/bit data rate, or 10 bits/sec. These bit patterns are shifted to the pattern recognition 196 where a 5 volt signal for 1010 ("1") or a 0 volt signal for 1000 ("0") is generated and transferred to interface 197. All other patterns (e.g. 1111, 1011, and 1101) are considered generated by noise and therefore ignored, and the level remains that which was previously set until a valid pattern is recognized. The signal from interface 197 is thus the decoded signal from sensor sub 22 that is fed to the microprocessor associated with the MWD tool 17.

Figure 18:
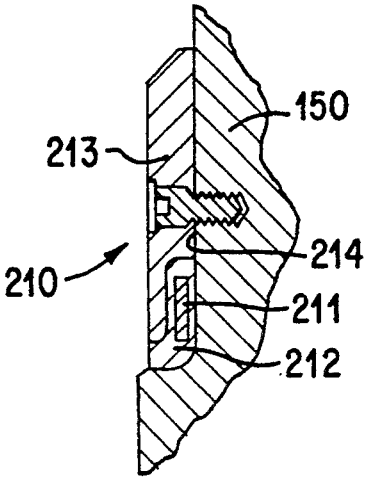
FIG. 18 is an enlarged, fragmentary cross-sectional view of the electromagnetic antenna coil assembly used on the receiver sub.

In another preferred embodiment of the present invention, an electromagnetic form of telemetry is used to communicate between the sensor sub 22 and the receiver sub 18. Referring again to FIG. 16A, the wires that extend down the groove 209 provide the two leads of an electromagnetic antenna coil indicated generally at 210. The antenna coil 210, which is shown in enlarged detail in FIG. 18, has essentially the same construction as the coil assemblies 250 and 251 on the sensor sub 22 as previously described. Briefly, the coil assembly 210 includes a relatively thin, large diameter metal ring 211 having high magnetic permeability which is encased in an insulative elastomer body 212. A number of turns of insulated conductor wires are wound around the ring 211, as in previous embodiments. The ring 211 is mounted in an external annular recess 214 on the housing 150, and is protected by a sleeve 213 that is secured to the housing 150 by cap screws or the like. The two ends or leads of the wire turns are brought up through the groove 209 in the outer surface of the housing 150 under the cover plate 209' (FIG. 16A) and into the inside of the housing via the high pressure feed-through connector 206. Electric currents flowing axially through the housing 150 inside the coil 211 as a result of the modulated operation of the transmitting coil antenna 250 on the sensor sub 22 when in communicating mode will generate magnetic fields in the ring 211 which cause voltages to appear across the leads of its wire turns. These voltages are fed to electrical circuits in the internal cavity 171 where they are amplified, demodulated, processed and fed to a microprocessor in the MWD tool 17. The general function of the antenna coil 210 will be discussed below.

Figure 19:
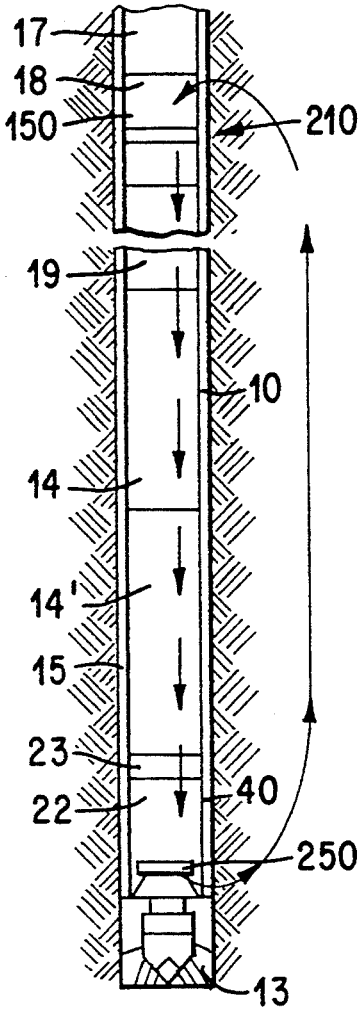
FIG. 19 is a schematic illustration of electromagnetic telemetry between the sensor sub and the receiver sub.

FIG. 19 further illustrates schematically the electromagnetic telemetry link between the sensor sub 22 and the receiver sub 18. Using the principles discussed above respecting measurement of formative resistivity, the transmitter coil 250 on the lower end of the housing 40 of the sensor sub 22, when switched to its communicating mode, operates to cause electric currents to flow out into the formation via the annulus 15 where they loop outward and upward through the formation as shown generally by the arrows. As before, axial current flow in the housing 40 is generated by the alternating current being applied to transmitter coil 250, and these currents loop outward through the formations and return to the housing 150 of the receiver sub 18 where they flow through the coil assembly 210 shown in FIGS. 16A and 18 and generate a voltage.

The currents transmitted by the sensor sub coil 250 when switched to its communicating mode thus can be encoded or modulated in any suitable manner, for example, by means of phase shift keying, to provide telemetry signals having discrete portions which represent the various measurements made by the transducers in or on the sensor sub 22. The voltages which appear across the leads of the coil turns on the receiver coil assembly 210 will be related to such signals, and thus can be decoded, processed, and transmitted to the receive-line of the microprocessor in the MWD tool 17. The currents also can be used to make an additional measurement of the resistivity of the formations by comparing the amplitude of the currents generated by the transmitter coil 250 to the amplitude of currents flowing through the receiver coil 210. The foregoing system of electromagnetic telemetry is disclosed in further detail in commonly-assigned U.S. patent application Ser. No. 07/786,137, now U.S. Pat. No. 5,235,285, noted above, which is again hereby incorporated herein by reference.

OPERATION

In use of the near-bit sensor sub 22 of the present invention, various combinations of tool string components such as those shown in FIG. 1 are assembled end-to-end and lowered into the borehole on the drill string 9. Assuming that the bottom of the hole is at the lower end of section A, a bent housing 16 will typically be included in the motor assembly 14 which will cause the bit 13 to drill a curved path along the sections C or E, depending upon whether an extended reach or a horizontal completion type of well is being drilled. The degree of bend provided by the bent housing 16 will primarily determine the radius of curvature. When the mud pumps at the surface are started to initiate circulation, the power section 14' of the mud motor assembly 14 rotates the drive shaft section 29 that extends down through the bent housing 16 and the sensor sub 22 to cause rotation of the spindle 39, the bit box 36, and the bit 13. So long as the drill string 9 is not rotated, the trajectory of the bit 13 will be along a curved path similar to that shown. The various measurements discussed above can be made continuously as the hole is deepened, namely inclination measurements, motor performance, (RPM and vibration levels) and formation characteristics (resistivity and gamma ray). Any time that the inclination measurements are not as expected, corrective measures can be taken immediately.

When the bit 13 reaches the end of the curved section C in FIG. 1, either the tool string can be removed from the borehole 10 to take the bent housing 16 out of the string, or the housing can be adjusted at surface or downhole to eliminate the bend angle, or the bent housing can be left in place and rotation of the drill string 9 superimposed over the rotation of the output shaft of the motor 14. Since under these later circumstances the bend point 8 will merely orbit around the axis of the hole, the bit 13 will drill straight ahead along the section D. The same procedures can be used in the case of the horizontal well 10'. When the bit 13 reaches the lower end of section E, the bent housing 16 can be removed or adjusted, or rotation can be superimposed to cause the bit to drill in a substantially horizontal direction, as shown, along section G into the formation F.

In the case of the extended reach well bore 10, when the hole has been lengthened to a point where it is to be curved downward along section C' toward the target formation $F_1$, the drill string is tripped out to replace the bent housing 16 if it was previously removed for the drilling of section D, or a downhole adjustable housing can be operated to establish an appropriate bend angle, or the superimposed rotation is stopped and the tool string rotationally oriented such that the tool face angle is the opposite to that used for drilling the upper section C. When the borehole has been curved downward along the section C' to the vertical (or to some angle off vertical, if desired), superimposed rotation again can be used to cause the bit 13 to drill straight down along section H into the target formation $F_1$. All the measurements discussed herein can be made continuously while the drill string is rotated except for inclination measurements. Such rotation should be halted momentarily to enable the accelerometers 74–76 to operate properly.

The present invention has particular application to the horizontally completed type of well shown in the middle part of FIG. 1. It generally is desirable to drill the section G of the borehole 10' substantially down the center of the formation $F_2$, that is, substantially equidistant from the over and underlying shales $S_A$ and $S_B$. This is because the lower portion of the formation $F_2$ may contain a relative abundance of water, and should be avoided. The upper portion of the formation may have a high natural gas content which also should be avoided where there is a commercial quantity of oil in the central portion. It is possible that after the bit 13 enters the formation $F_2$, the borehole could progress toward the top or toward the bottom thereof, and in an extreme case could actually project through one of the shale bed boundaries, particularly where an early warning of improper inclination is not given at the surface. In accordance with one aspect of the present invention, where the gamma ray measurements made by the sensor 78 show an increasing trend as the hole is lengthened, while at the same time the resistivity readings from the coil 251 also begin to change, it can be inferred that the borehole 10' is headed relatively upward toward the upper shale formation $S_A$. This could occur because the trajectory of the borehole 10' is not correct, or because the formation is dipping downward. In either event corrective measures can be taken to ensure a proper trajectory by providing a bend angle in the housing 16, or perhaps adjusting the weight-on-bit and/or the rpm of the motor 14, or orienting the tool face and bend angle in the proper direction and proceeding in sliding mode. If the gamma ray readings show an increasing trend while the resistivity values show a decreasing trend, then it can be inferred that the borehole 10' is headed relatively downward toward the lower shale formation $S_B$. Hereagain, corrective measures can be taken to cause the borehole 10' to be drilled back into the central part of the formation $F_2$ where the two measurements should remain substantially constant as the borehole is lengthened.

For these same purposes, the gamma ray detector 78 is focused by reason of the reduced thickness of the wall 83 of the housing 40 adjacent thereto, and the attenuation due to a large cumulative thickness of metal on its opposite side, so that its measurements are primarily azimuthal. Thus the tool string and the sensor sub 22 can be rotated between successive angular positions as the section G is being drilled while the measurements are observed to detect the general orientation in which there is an increased natural emission of gamma rays from the formations. When a resistivity electrode in the form of the assembly 221 shown in FIG. 9 is used, its measurements also are radially focused in the sense that it is affected primarily by electric currents coming through the formation from a direction that is radially outward of it. Thus the resistivity measurement that is made using the assembly 221 also is azimuthal compared to measurements made by an annular electromagnetic antenna, so that readings made at various angular orientations of the sensor sub 22 can be used to observe whether there is increased or reduced resistivity in a certain generally radial outward direction.

The present invention also might be used to detect an over-pressured formation. In addition to the uses previously mentioned, the level of vibrations detected by the sensor 102 can be related to rock density which should have a normal trend that increases with depth. Where the measured values have a different trend than would otherwise would be expected, it can be inferred that the bit 13 is approaching a high pressure formation which can cause a blow-out if the mud weight is not adjusted.

As explained previously, the rpm sensor 85 is used to detect downhole if the mud circulation rate being used is producing an expected rate of rotation of the drive shaft 30, or not, which may indicate a worn motor stator. To some extent the circulation rate can be adjusted upward or down to achieve the proper rpm. A comparison with surface pump pressures also can indicate the degree of wear of the stator of the motor 14. The output of the rpm sensor also can be used to switch the battery power supply in the sensor sub 22 off to conserve energy during periods when the motor 14 is not operating, or within a discrete number of seconds after operation of the motor is stopped for any reason. If the rpm measurement oscillates, it is probable that the lower end of the drill string is rotationally oscillating back and forth, which can be eliminated, if undesirable, by adjusting the weight-on-bit, for example.

By way of a summary of the telemetering system disclosed herein, signals from the various measurement devices and systems in the sensor sub 22 are input to the microprocessor 178 and the timing circuit 177, and a telemetry frame of electrical excitations or bursts 132 are applied across the leads 126, 126' of the sonic transmitter 72. The frame includes a plurality of discrete time intervals so that a certain one of the intervals represents a particular measurement, plus a starting or timing frame of bursts. The ceramic crystals 107 undergo displacements which drive the coupling block 110 so that it imparts corresponding sonic vibrations to the walls of the sensor sub housing 40. The vibrations, which may be viewed a sectional deformations of the collar, travel upward through the metal components of the drill string above the sensor sub 22 until they arrive at the receiver sub 18. There, the sonic signals are detected by a sonic receiver 142 essentially the same as sonic transmitter 72, or by a conventional accelerometer 302. These pulses are filtered and decoded by the circuits shown in FIG. 15, with the resulting signals being input to the microprocessor receive-line in the MWD tool 17. The internal control functions of the tool 17 cause the valve 25 to be modulated in a manner such that pressure pulses created in the mud circulation stream are, in part, representative of each of the sensor sub measurements. The pressure pulses are detected at the surface by the transducer 3 and are decoded and processed so that the values of the downhole measurements are available for analysis substantially in real time. Of course, certain other segments of the pressure pulse train represent the measurements made by the MWD tool 17 itself, or by other LWD tools associated therewith, some of which can be compared to the above measurements to provide other valuable information.

Figure 21A:
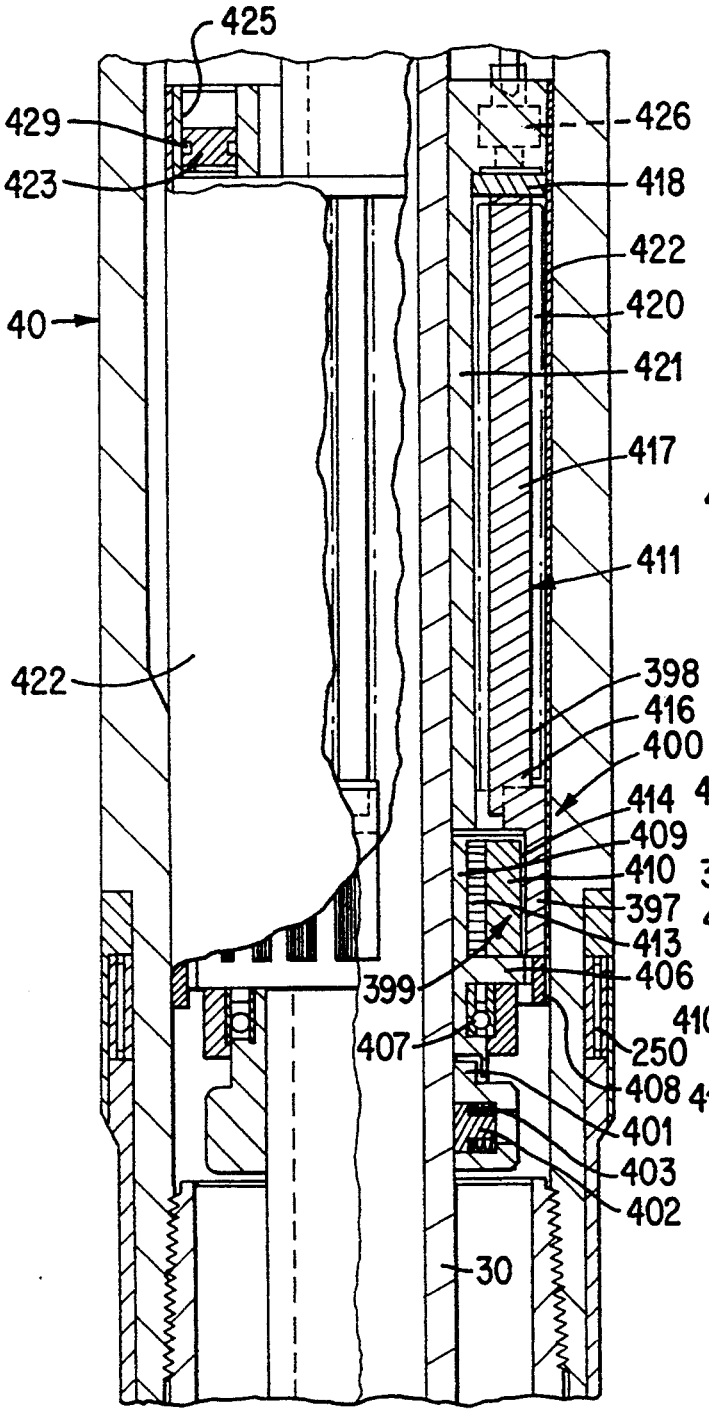
FIG. 21A is a longitudinal sectional view, with some parts in side elevation, of an alternator power supply for the present invention.

An alternative to the use of the batteries 73 as a source of power for the sensor sub 22 is shown in FIGS. 21A and B. Here an alternator assembly indicated generally at 400 is positioned inside the lower portion of the housing 40 shown in FIG. 3B, or the assembly can be positioned in a separate housing sub that is threaded to the housing 40. The alternator 400 includes a rotating field or rotor 399 which rotates inside the lower end portion of a stationary-armature or stator assembly 398. The rotor 399 is mounted on the drive shaft 30 of the drilling motor 14 and rotates therewith, and includes a torque limiter sleeve 401 which carries radially movable dogs 402 biased inward by springs 403. The torque limiter sleeve 401 slides up and down in carriage 406 to allow for axial misalignment and vibration. Friction between the dogs 402 and the drive shaft 30 transmits torque to the rotor 399. The dogs 402 automatically compensate for any misalignment of the drive shaft 30 due to machining, assembly or vibration. Torque limiter carriage 406 is mounted for rotation in ball bearings 407 which are centered within the housing 40 by a ring 408.

The upper section 409 of carriage 406 is made of non-magnetic material and has a plurality of longitudinal slots which carry a corresponding plurality of circumferentially spaced permanent field magnets 410. The inner surface of each magnet 410 engages the outer periphery of a ferromagnetic ring 413, and a thin protective cover 414 made of a similar material can be used as shown. The sleeve 401 and the magnets 410 rotate with the drive shaft 30 any time that mud is being circulated down the drill string 9 and back up to the surface through the annulus 15. The magnets 410 rotate inside the lower end portions 397 of a plurality of stator bars 411. Each of the stator bars 411, which is made of a laminated ferromagnetic material, includes such lower end portion 397 which has approximately the same width as a magnet 410. Such lower end portion 397 is generally L-shaped and is joined to the lower end 416 of an elongated bar member 417. The tipper end of each bar member 417 contacts a ring 418 which also is made of a ferromagnetic material. Each of the bar members 417 carries a winding 420 thereon (shown in dash-dot-dash lines), with the number of turns in each winding being fairly large. The two ends of the winding 420 on each stator bar 411 are electrically connected in a manner such that the current output of the alternator assembly 400 is 3-phase.

The stator bars 411 are positioned in longitudinally extending circumferentially spaced slots in a tubular carrier body 421 that is fixed within the housing 40 by suitable means (not shown). The carrier body 421 is made of a non-magnetic material, and all void spaces therein are filled with oil. A thin non-magnetic sleeve 422 surrounds the carrier body 421 and is sufficiently compliant to substantially equalize pressures inside and outside the carrier body. For further compensation, several balance pistons 423 which carry seal rings 424 are located in bores 425 in the upper end section of the carrier body 421. The pistons 423 can move up and down to compensate for changes in internal volume on account of downhole pressures and temperatures. The output current is brought out at the upper end of the carrier body 421 by a suitable multi-pin connector 426. From there the output is wired into the electronic components of the tool in the cavities 68, 69 and 70 for use as the power supply.

Figure 21B:
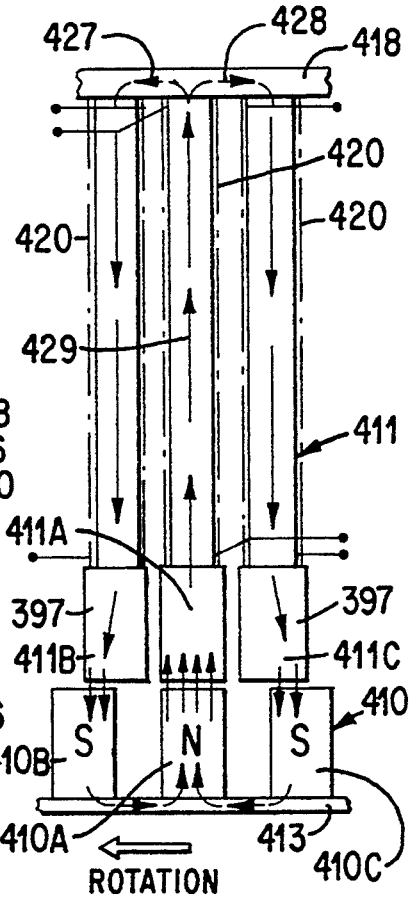
FIG. 21B is a developed plan view showing magnetic circuits in the alternator.

The manner in which current is generated is shown schematically in FIG. 21B, which is a developed plan view of three of the magnets 410 and a corresponding number of the stator bars 411. Although the magnets 410 are shown as being positioned below the lower end portions 397 of the bars 411 for purposes of simplifying the explanation, the magnets actually rotate inside such lower end portions as shown in FIG. 21A. The magnets 410 have alternating polarities as shown by the letters N and S, and the ratio of the number of magnets 410 to the number of stator bars 411 preferably is two to three. As there are three stator bars 411 for each two magnets 410, the outputs of the three windings 420 illustrated in FIG. 21B are 120 degrees out of phase relation to each other, producing a 3-phase signal. In an exemplary embodiment, and not by way of limitation, the stator assembly 398 can have eighteen bars 411 and the rotor assembly 399 twelve magnets 410. Thus when a north magnet 410A is axially aligned with the stator bar 411A, the adjacent south magnets 410B and C are misaligned by about one-half their width with the stator bars 411B and C. As shown by the large arrow at the bottom of FIG. 21B, the rotor assembly 399 may be considered to be rotating clockwise, or to the right, as viewed from above.

In the rotational position shown in FIG. 21B, maximum flux lines emanating from the N magnet 410A enter the lower portion 397 of the stator bar 411A where they pass upward therein as shown by the arrows 429. At the top of the bar 411A, the flux lines pass into the ring 418 and then divide as shown by the arrows 427 and 428. Then the lines pass downward through the bars 411B and C, and at the bottoms of the end portions 397 the lines enter the south magnets 410B and C. Finally the lines pass back into the lower end of the North magnet 410A via the ring 413 to complete the magnetic circuits. The flux lines in the stator bar 411A induce a current flow in the windings 420 thereon in one direction, while the lines in the bars 411B and C induce current flow in their windings in the opposite direction. When the north magnet 410A rotates opposite the lower end of the bar 411B, the direction of the flux lines are reversed, as are the currents induced in the windings 420. Thus as the rotor magnets 410 rotate relative to the stator bars 411, alternating current is provided.

The output of the alternator 400 can be rectified, if needed, and regulated by suitable electronic components in the sensor sub cavity 68. A large number of coil turns is used on each stator bar 411 to ensure adequate voltage at low rotary speeds of the drive shaft 30, which typically turns in the range of from 80–500 rpm. The axis of each winding 420 is parallel to the axis of rotation of the shaft 30. Due to the large number of turns, the alternator 400 of the present invention can be considered to be highly inductive, which limits the increase in output voltage with increasing drive shaft rpm. Moreover the magnetic path inside each winding 420 is relatively long to provide sufficient turns. Thus eddy current losses are important, which also increase with drive shaft rpm, and limit the voltage output therewith. The foregoing effects facilitate the control of the voltage output of the alternator assembly 400, and ensures a wide dynamic range of operation. Heat generated in the windings is dissipated to the mass of the housing 40 as well as the surrounding oil and drilling mud so that there are no significant temperature increases. The various "gaps" between the rotating field magnets 410 and the stator coils are in fact filled with either non-magnetic steel or fluids (oil or mud). Thus no air gaps with high reluctance are present.

The clutch 402 ensures that if the alternator rotor 399 becomes stuck in the stator 398, the clutch will slip so that the full motor torque, which can be quite high, is not applied to the alternator 400. The clutch 402 is designed such that small, continuous axial vibrations of the drive shaft 30 are not transmitted to the alternator rotor 399. Vibration amplitude of up to one-half inch can be accommodated.

A measurement of the frequency of the current output of one phase of the alternator 400 provides a measurement of the rpm of the drive shaft 30, and thus of the motor 14. This value is highly useful and can be transmitted to the surface in real time. As mentioned above, regulation of the output of the alternator 400 can be performed by directing part of the rectified current through a transistor installed in parallel on a power supply board in cavity 68. The voltage input to the board is kept constant by increasing the amount of current that is diverted when the rpm of the shaft 30 increases. Other advantages to using an alternator as disclosed herein rather than a battery power supply are increased sampling rate for all near bit measurements, higher quality resistivity measurements in oil-based mud, lower maintenance costs, faster maintenance, increased reliability and increased temperature tolerance.

It now will be recognized that new and improved methods and apparatus have been disclosed which meet all the objectives and have all the features and advantages of the present invention. Since certain changes or modifications may be made in the disclosed embodiments without departing from the inventive concepts involved, it is the aim of the appended claims to cover all such changes and modifications falling within the true spirit and scope of the present invention.

What is claimed is:

1. Apparatus for use in making downhole measurements during the drilling of a borehole using a bit at the bottom end of a drill string, said bit being rotated by a mud motor assembly having a power section, said apparatus comprising in combination: a measuring-while-drilling tool above said motor assembly and including first means for telemetering signals representative of downhole measurements to the surface; sensor means between said power section of said motor and said bit for making downhole measurements near said bit; and second telemetering means associated with said sensor means for producing bursts of acoustic waves which are representative of said downhole measurements made by said sensor means and for telemetering said waves to said first telemetering means via said drill string to enable said first telemetering means to relay signals representative thereof to the surface, each of said bursts having a predetermined number of oscillations and being time-spaced in a manner such that no oscillation appears between bursts.

2. The apparatus of claim 1 further comprising means included in said sensor means for making measurements of at least one of the following: gamma rays emanating naturally from the formations, electrical resistivity of the formations, inclination of the borehole, and motor performance characteristics.

3. The apparatus of claim 2 further including means for focusing at least one of said gamma ray and said resistivity measurements to provide a generally azimuthal measurement thereof.

4. Apparatus for use in making downhole measurements during the drilling of a well bore with a drill string having a motor included therein that rotates a drill bit, said motor having a power section that drives an output shaft that is coupled to the bit, comprising: sensor housing means including a tubular housing and a mandrel mounted inside said housing, said mandrel having a central bore through which a portion of said shaft extends; annular chamber means between said housing and said mandrel; sensor means mounted in said chamber means for making said downhole measurements and producing signals which are representative thereof; and acoustic means for transmitting bursts of acoustic waves which are representative of said signals upward along the drill string to a receiver that is located above said motor, each of said bursts having a predetermined member of oscillations and being time-spaced in a manner such that no oscillation appears between bursts.

5. The apparatus of claim 4 further including upper and lower means mounted externally on said housing for measuring the electrical resistivity of earth formations surrounding said well bore adjacent said sensor means.

6. The apparatus of claim 5 wherein one of said measuring means is mounted radially on said housing to provide a substantially laterally focused, azimuthal response.

7. The apparatus of claim 4 wherein said means for making said downhole measurements includes detector means for producing an output in the presence of gamma rays which emanate naturally from said formation.

8. The apparatus of claim 7 further including means for substantially focusing the response of said detector means so that it responds primarily to gamma rays emanating from a selected outward radial direction.

9. The apparatus of claim 8 wherein said focusing means includes a wall section of said housing adjacent said detector means having reduced radial thickness.

10. The apparatus of claim 4 wherein said means for making said downhole measurements includes detector means for measuring the number of revolutions per minute of said drive shaft, said detector means comprising: a tubular housing having said shaft extending axially therethrough; means fixed to said shaft and carrying at least one magnet that rotates with said shaft; magnetically operable sensing means mounted on said housing adjacent the path of rotation of said magnet; and means associated with said sensing means for measuring the change in flux density opposite said sensing means as a function of time due to rotation of said magnet therepast.

11. The apparatus of claim 10 further including means for fixing said magnet on said shaft including inner and outer sleeve members threaded to one another and defining an internal annular cavity; ring means in said cavity engageable with the outer surface of said shaft; and inclined surface means on said ring means and said inner and outer members for forcing said ring means radially inward into tight gripping engagement with said outer surface of said shaft.

12. A method of transmitting signals representing downhole measurements from a measurement sub positioned near the bit in a drill string that includes a mud motor assembly and a measuring and telemetry tool in the drill string above the mud motor assembly, comprising the steps of: making measurements with said measurement sub and producing a telemetry frame of encoded signals to drive a transmitter that produces bursts of sonic vibrations and couples said vibrations into the walls of the drill string, each of said bursts having a predetermined number of vibrations and being time-spaced in a manner such that no vibration appears between bursts; transmitting said vibrations up through the walls of the drill string to a receiver that is associated with said measuring and telemetry tool; sensing said vibrations with said receiver and producing output signals representative thereof; decoding said output signals to provide noise-avoidance; processing said output signals to convert them into digital signals; feeding said digital signals to said measuring and telemetry tool; and using said measuring and telemetry tool to transmit to the surface pressure pulses in the drilling mud that represent said digital signals, so that said pressure pulses can be detected and decoded at the surface to reproduce the said measurements for display and analysis.

13. The method of claim 12 including the steps of exciting said transmitter in a manner such that it produces sequences of individual bursts of sonic vibrations; and timing said bursts such that they provide digital data.

14. The method of claim 12 wherein said sensing step includes recognizing patterns of said digital output signals; and converting said patterns to digital signals which are fed to said measuring and telemetry tool.

15. The method of claim 12 further including the steps of filtering said output signals; storing the filtered signals in a register; and sensing the content of said register at selected time intervals.

16. The method of claim 13 wherein said exciting step is accomplished at two different repetition rates, one of said rates corresponding to a bit one and the other of said rates corresponding to a bit zero.

17. The method of claim 12 including the step of operating said receiver in a manner such that it resonates at the carrier frequency to thereby act as a bandpass filter to provide improved noise rejection.

18. The apparatus of claim 2 wherein one of said characteristics is the rpm of the output drive shaft of said mud motor assembly.

19. The apparatus of claim 2 wherein one of said characteristics is the level of vibration experienced by said motor assembly during the drilling process.

20. The apparatus of claim 18 wherein another of said performance characteristics is the level of vibrations in the drill string adjacent said sensor sub.

21. The apparatus of claim 1 wherein said sensor means includes a housing, a drive shaft extending between said power section and said bit and passing through said housing, and further including means in said housing responsive to rotation of said drive shaft for producing electric power to operate said sensor means and said second telemetering means.

22. The apparatus of claim 21 wherein said producing means includes field means mounted on said drive shaft and rotating therewith, and stator means mounted in said housing in a manner such that rotation of said field means induces alternating current flow in said stator means.

23. The apparatus of claim 22 further including torque limiting means for enabling said field means to slip relative to said drive shaft at a predetermined torque level.

24. The apparatus of claim 23 wherein said torque limiting means includes radially shiftable dog means engaging said drive shaft, and resilient means for holding said dog means in said engaged position.

* * * * *

UNITED STATES PATENT AND TRADEMARK OFFICE

CERTIFICATE OF CORRECTION

PATENT NO. : 5,448,227
DATED : September 5, 1995
INVENTOR(S) : Jacques Orban and Neil W. Richardson It is certified that error appears in the above-indentified patent and that said Letters Patent is hereby corrected as shown below:

Column 26, line 57, after "signals" insert -- that represents each of said measurements; using said encoded signals --

Signed and Sealed this

Eighteenth Day of June, 1996

*Attest:*

*Attesting Officer*

BRUCE LEHMAN

*Commissioner of Patents and Trademarks*